US007900319B2

(12) United States Patent
Bacchetti

(10) Patent No.: US 7,900,319 B2
(45) Date of Patent: Mar. 8, 2011

(54) HINGE STRUCTURE FOR SELF-CLOSING DOORS

(75) Inventor: Luciano Bacchetti, Nave (IT)

(73) Assignee: Dianora Gosio, Nave (Brescia) (IT)

( * ) Notice: Subject to any disclaimer, the term of this patent is extended or adjusted under 35 U.S.C. 154(b) by 373 days.

(21) Appl. No.: 12/299,011

(22) PCT Filed: May 3, 2007

(86) PCT No.: PCT/IB2007/051663

§ 371 (c)(1),
(2), (4) Date: Nov. 20, 2008

(87) PCT Pub. No.: WO2007/125524

PCT Pub. Date: Nov. 8, 2007

(65) Prior Publication Data

US 2010/0199459 A1 Aug. 12, 2010

(30) Foreign Application Priority Data

May 3, 2006 (IT) ..... V12006A0131
Jul. 11, 2006 (IT) ..... VI2006A0216
Oct. 19, 2006 (IT) ..... VI2006A0307

(51) Int. Cl.
*E05D 5/02* (2006.01)

(52) U.S. Cl. ..... 16/252; 016/382; 016/286

(58) Field of Classification Search ..... 16/286, 16/252, 236, 382, 332, 330, 245, 54, 50; 4/607, 614, 557

See application file for complete search history.

(56) References Cited

U.S. PATENT DOCUMENTS

| | | | | |
|---|---|---|---|---|
| 3,512,210 | A * | 5/1970 | Ratcliffe | 16/347 |
| 3,566,434 | A | 3/1971 | Grinsteiner | |
| 5,867,869 | A * | 2/1999 | Garrett et al. | 16/252 |
| 6,481,055 | B2 * | 11/2002 | Cheng | 16/252 |
| 6,560,821 | B2 * | 5/2003 | Miller et al. | 16/252 |
| 6,704,966 | B1 * | 3/2004 | Kao | 16/252 |
| 6,766,561 | B1 * | 7/2004 | Cheng | 16/235 |
| 7,114,292 | B2 * | 10/2006 | Chiang | 49/388 |
| 7,188,390 | B2 * | 3/2007 | Cheng | 16/252 |

FOREIGN PATENT DOCUMENTS

| | | |
|---|---|---|
| DE | 29618578 | 12/1996 |
| GB | 396889 | 8/1933 |

* cited by examiner

*Primary Examiner* — Chuck Y. Mah
(74) *Attorney, Agent, or Firm* — Themis Law

(57) ABSTRACT

A hinge structure (1) for self-closing doors or the like comprises a first stationary element (2) attachable to the frame (T) of a door (P), a first movable element (3) securable to the door (P) and pivotally mounted to the first stationary element (2) for rotating about a longitudinal axis (X) between an open door position and a closed door position. The structure (1) further comprises closing means (4) acting on the first movable element (3) for automatically returning the door (P) to the closed position during opening, hydraulic damping means (5) operating on the first movable element (3) to oppose and damp the movement produced by the closing means (4). The closing means (4) and the hydraulic damping means (5) are housed within a first operating chamber (6) locate internally of the first stationary element (2). An assembly incorporates such hinge structure.

30 Claims, 24 Drawing Sheets

HINGE STRUCTURE FOR SELF-CLOSING DOORS

FIELD OF THE INVENTION

The present invention finds application in the field of hinges and suspension hardware for doors or the like, and particularly relates to hinge structure for self-closing doors.

The hinge structure of the invention can assure self-closing of any kind of door, window or shutter, whether horizontally or vertically oriented, particularly of glass doors.

The invention further relates to an assembly incorporating such hinge structure.

BACKGROUND OF THE INVENTION

Hinge structure for self-closing doors or the like, particularly glass doors or the like are known in the art.

These prior art hinge structures comprise, as is known, a stationary element to be fixed to the frame of a door, a first movable element to be attached to the door and pivotally mounted to the stationary element for rotating about a longitudinal axis between an open door position and a closed door position.

These prior art hinge structures further comprise means for automatically returning the door to said closed position during opening thereof.

These prior art hinge structures suffer from certain well-recognized drawbacks.

A first drawback is their bulky size, heavy weight and high cost, caused by their being formed of many different parts, which further complicate their assembly and maintenance.

Furthermore, they exhibit poor versatility and have to be replaced or anyway adjusted as the door or frame on which they are mounted changes.

Also, these prior art hinge structures do not assure controlled motion of the door during opening and closing thereof. This problem is particularly felt with glass doors, whose closing and opening movements must be smooth, to avoid irreversible damages to the door itself.

However, the behavior of these prior art structures is highly affected by the mass of the door on which they are mounted.

Furthermore, in operation, these prior art hinge structures are subjected to variations in their closing position, which leads to inconveniences and higher maintenance costs.

Moreover, the known structures do not allow the automatic closing movement of the door upon the opening.

SUMMARY OF THE INVENTION

The main object of this invention is to obviate the above drawbacks, by providing an hinge structure allowing for easy and convenient maintenance, that has high performance, simple construction and low cost properties.

One object of the invention is to provide a hinge structure that allows the automatic closing of the door from the open position.

A particular object is to provide a hinge structure that allows the controlled motion of the door with which it is connected.

A further object is to provide a hinge structure that can support doors and windows of heavy weight without changing their behavior and without requiring any adjustment.

A further object of the invention is to provide a hinge structure that has a minimized number of parts and can be adapted to multiple shells of different shapes and sizes.

Yet another object of the invention is to provide a hinge structure that can keep its closing position unaltered with time.

Another object of the invention is to provide a highly safe hinge structure that offers no resistance to the closing motion even when pulled abruptly.

These and other objects, as better explained hereafter, are fulfilled by a hinge structure as defined in claim 1.

Advantageously, the closing means may be held in the first operating chamber, and the hydraulic damping means may be held either in the first operating chamber or in a second operating chamber, other than the first chamber.

In another aspect, the invention relates to a hinge assembly for self-closing doors or the like as defined in claim 20.

Advantageous embodiments of the invention are defined in accordance with the dependent claims.

BRIEF DESCRIPTION OF THE DRAWINGS

Further features and advantages of the invention will be more apparent upon reading the detailed description of a few preferred, non-exclusive embodiments of the hinge structure and assembly of the invention, which are described as non-limiting examples with the help of the annexed drawings, in which.

DETAILED DESCRIPTION OF A FEW PREFERRED EMBODIMENTS

Figure 1:
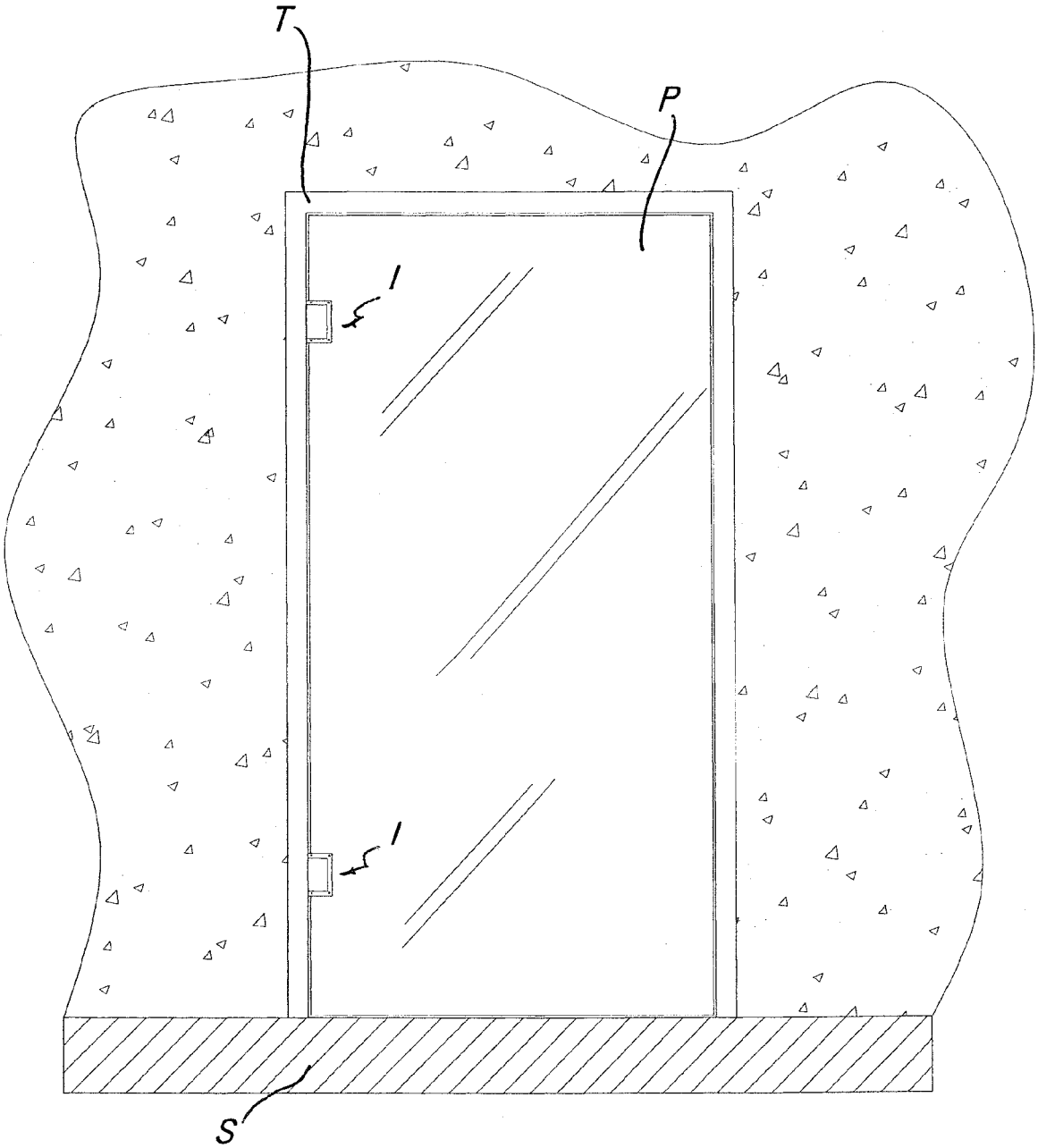
FIG. 1 is a plan view of a door with the hinge structure of the invention mounted thereto.
Figure 2:
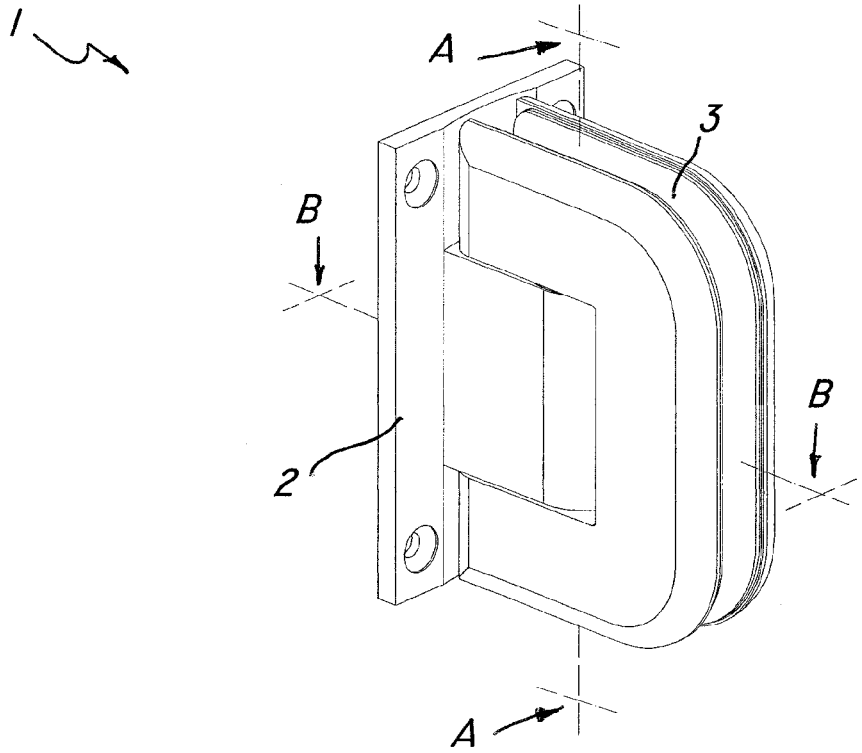
FIG. 2 is an axonometric view of a first embodiment of the hinge structure of the invention, in the closed door position.
Figure 3:
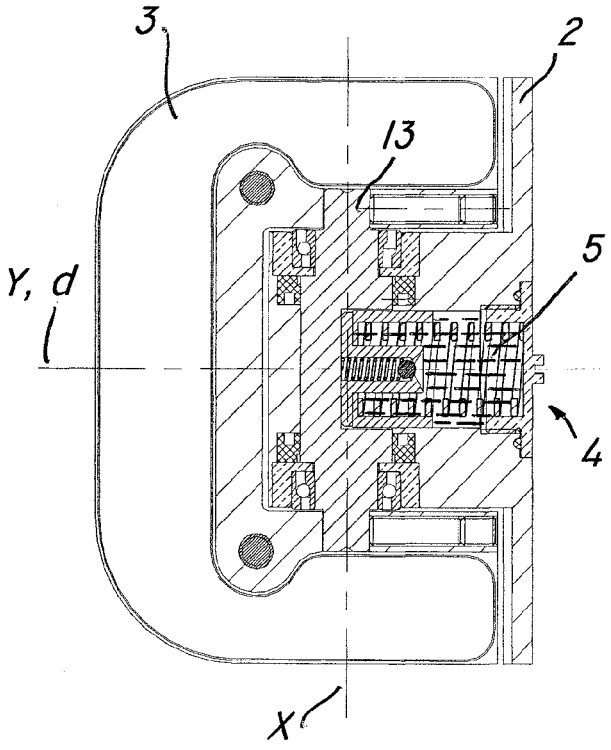
FIG. 3 is a sectional side view of the hinge structure of FIG. 2, as taken along a plane A-A.

Referring to the above figures, there are shown embodiments of a hinge structure for self-closing doors or the like, generally designated by numeral 1, which may be mounted, preferably but without limitation, on glass doors.

In all its embodiments, the hinge structure 1 essentially comprises a stationary element 2 to be fixed to a frame T of a door P and a movable element 3 to be fixed to the door P. The movable element 3 is pivotally mounted to the stationary element 2 for rotating about a first longitudinal axis X between an open door position and a closed door position.

The hinge structure 1 further comprises closing means, generally designated by numeral 4 and hydraulic damping means, generally designated by numeral 5, which may consist in the embodiments described herein without limitation, of a predetermined amount of oil.

The closing means 4 operate on the first movable element 3 for automatically returning the door to the closed position during opening, and the hydraulic damping means 5 operate on such element 3 to oppose and damp the movement produced by the closing means 4.

A peculiar feature of the invention, common to all the embodiments described herein, is that the closing means 4 and the hydraulic damping means 5 are held in at least one first operating chamber 6 within the stationary element 2.

By this arrangement, a hinge structure can be obtained that allows controlled pivotal motion of the door. This means that, when the door is in an open door position, the closing means 4 will operate on the movable element 3 and generate a torque to cause the door P to rotate to its closed position about the axis X. On the other hand, at each time, the hydraulic damping means 5 will operate on such movable element 3 to generate a resistant torque opposite to the torque generated by the closing means 4.

The hinge structure of the invention also provides high safety, as it offers no resistance to the closing motion even when pulled abruptly. This will prevent any injury to careless users, particularly children. Regardless of the force exerted on the door, the latter will always return smoothly to the closed door position, thereby providing a childproof safety.

The hinge structure of the invention is also particularly efficient and cost effective, as it can keep its initial characteristics unaltered with time even when used in severe conditions with high moisture content and passage of moisture.

Furthermore, thanks to the provision that the closing means 4 and the hydraulic damping means 5 are wholly contained in at least one first operating chamber 6 within the stationary element 2, the hinge structure 1 is particularly convenient to handle, and has a small size, and minimized space requirements. Therefore, its installation requires no particular masonry or excavation works. As shown in the annexed figures, the structure 1 is fixed to the frame of a door (or to a wall) along the vertical extension of the door, above the level of the floor or the wall to which the stationary element is fixed.

The closing means 4 include a first cam element 11 unitary with the first movable element 3 and having a first substantially flat contact surface 16, and a first plunger element 12 movable within said first operating chamber 6 along a transversal axis Y between a compressed end stroke position, corresponding to the open door position, and an extended end stroke position, corresponding to the closed door position. The plunger element 12 has a front face 17 which is susceptible to contact engage the surface 16 of the cam element 11.

According to the invention, the first contact surface 16 of the first cam element 11 is offset with respect to the longitudinal axis X by a predetermined distance g such as the front face 17 of the plunger element 12 in its extended end position is positioned beyond said longitudinal axis X.

Figure 7A:
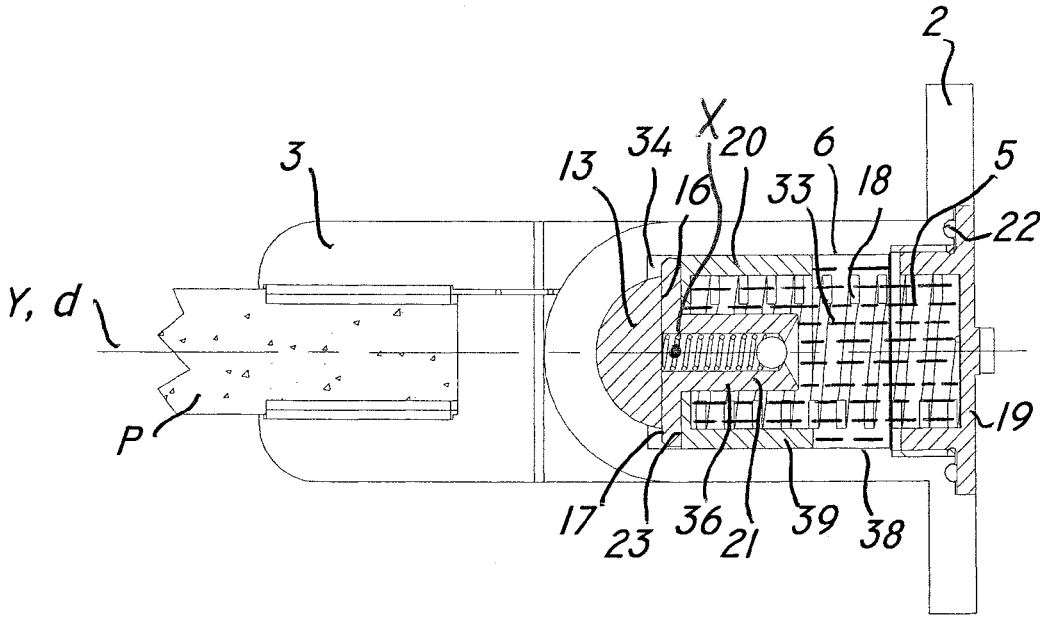
FIGS. 7*a* and 8*a* are sectional views of the hinge structure of FIG. 2, as taken along a plane B-B in the closed door and open door positions respectively.
Figure 20:
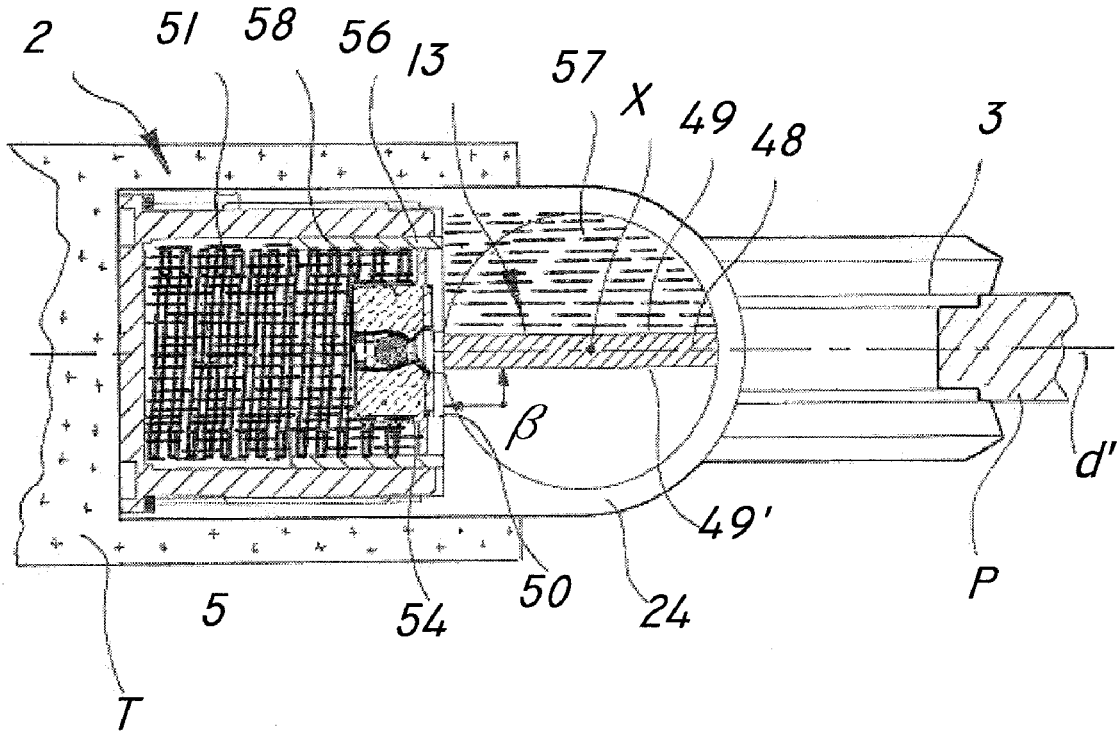
FIGS. 20 to 23 are sectional views of the device of FIG. 11, as taken along planes F-F and G-G, in the closed door position, in a partly open position during door opening, in the open door position and in a partly open position during door closing respectively.
Figure 20:
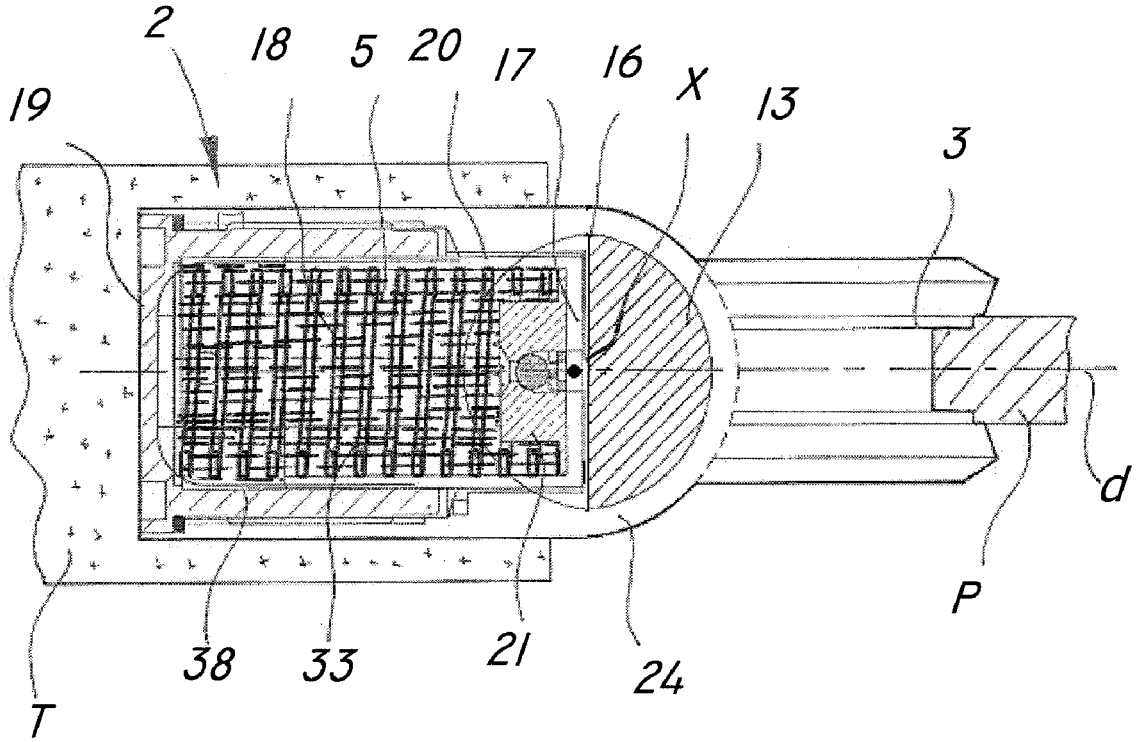
Figure 22:
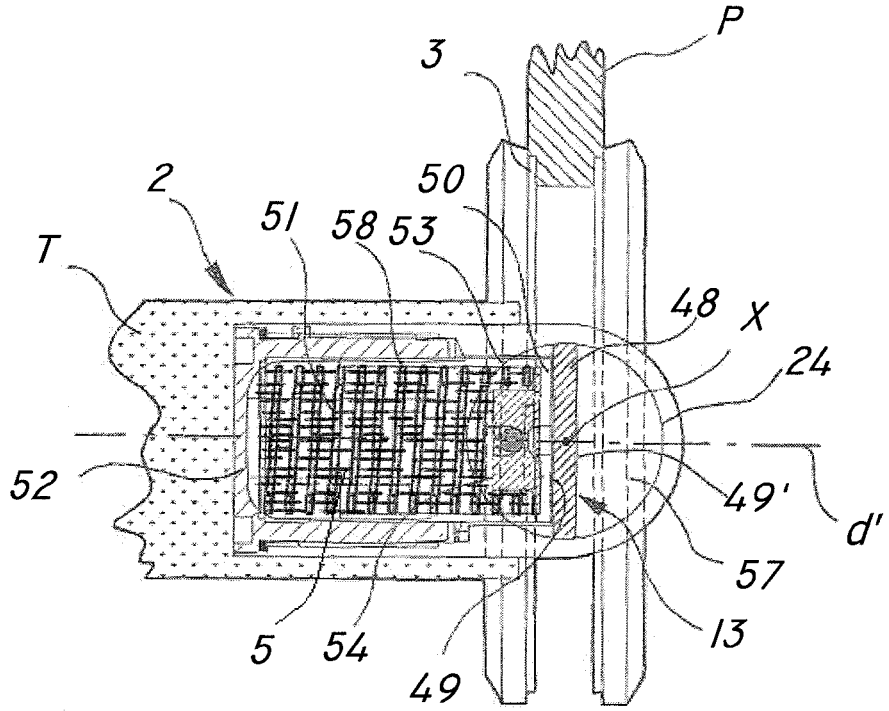
Figure 22:
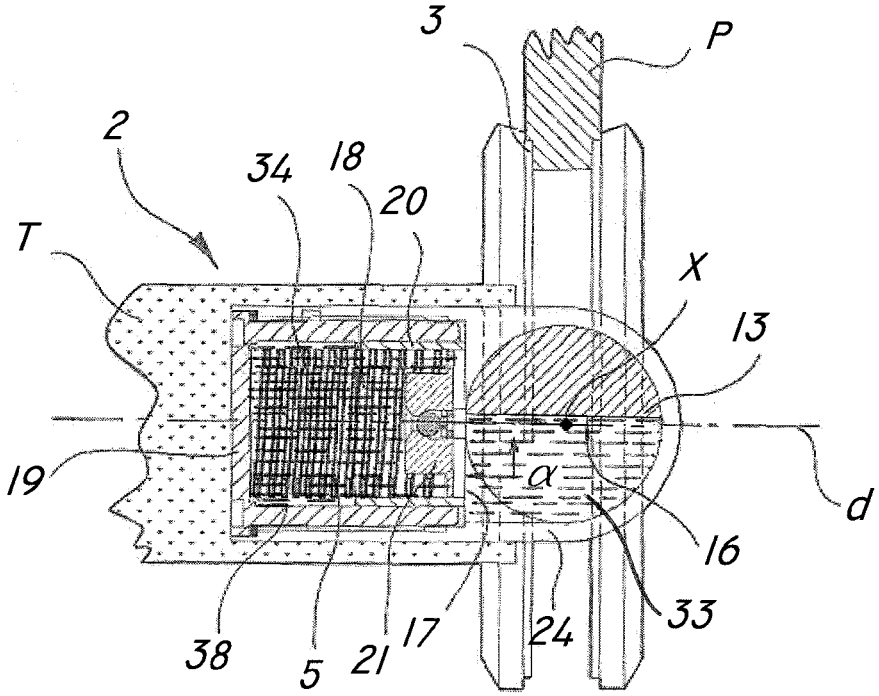
Figure 29:
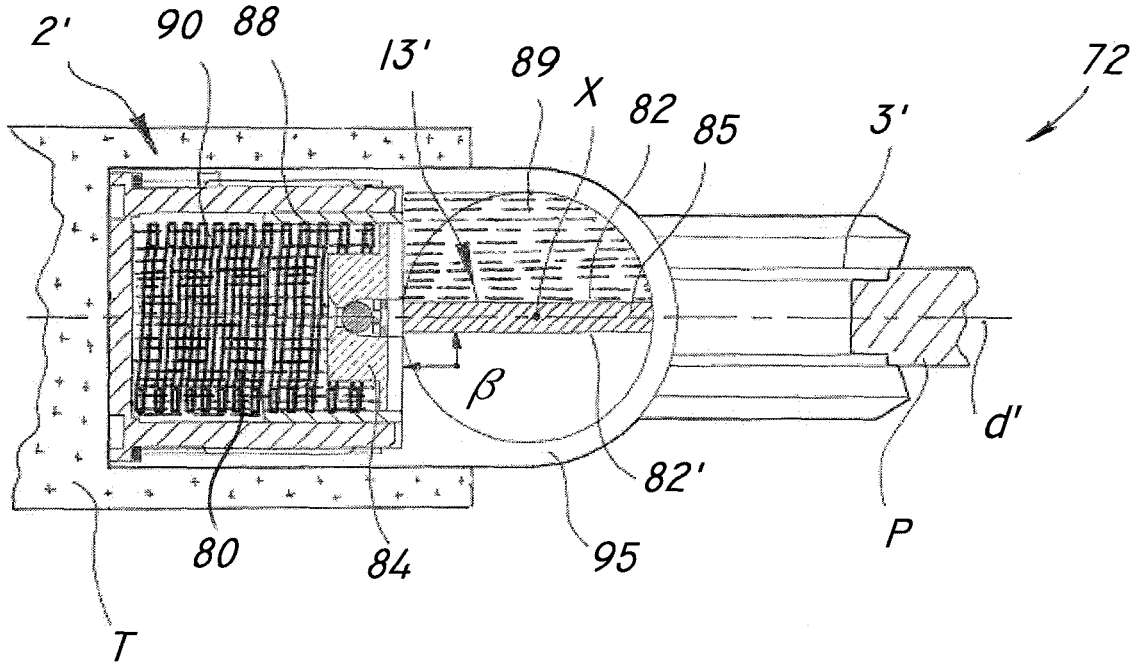
FIG. 29 is a view of the assembly of the invention in which the first and second hinge structures are cut away along respective planes L-L, L'-L', and in which they are in the closed door position.
Figure 29:
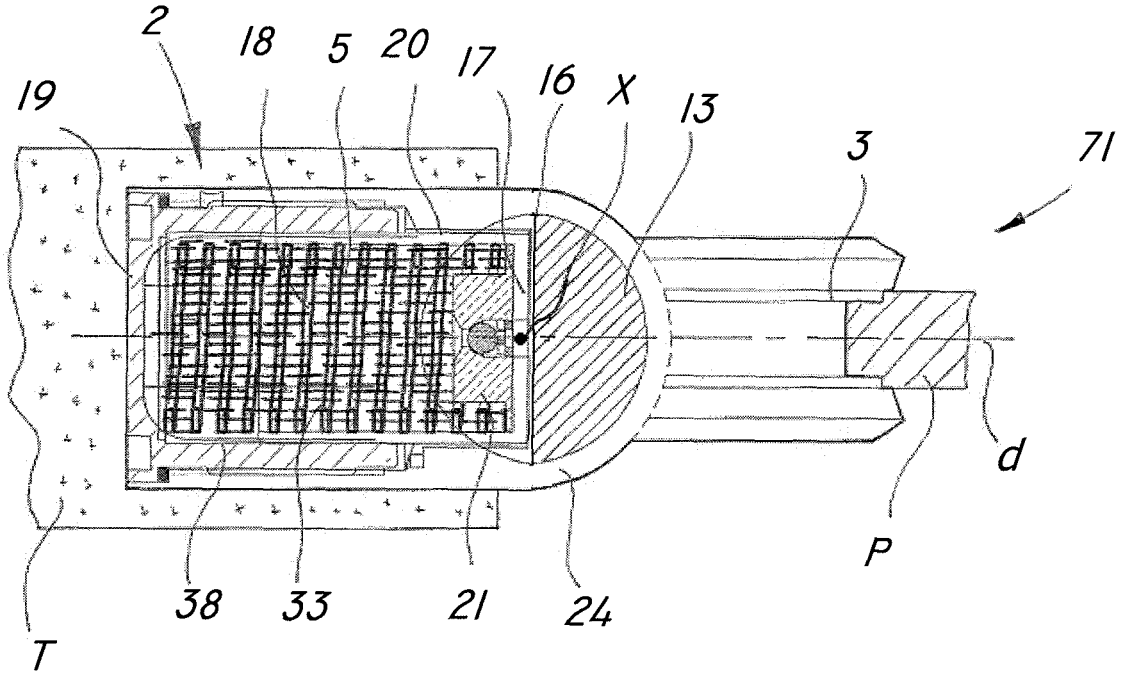
Figure 31:
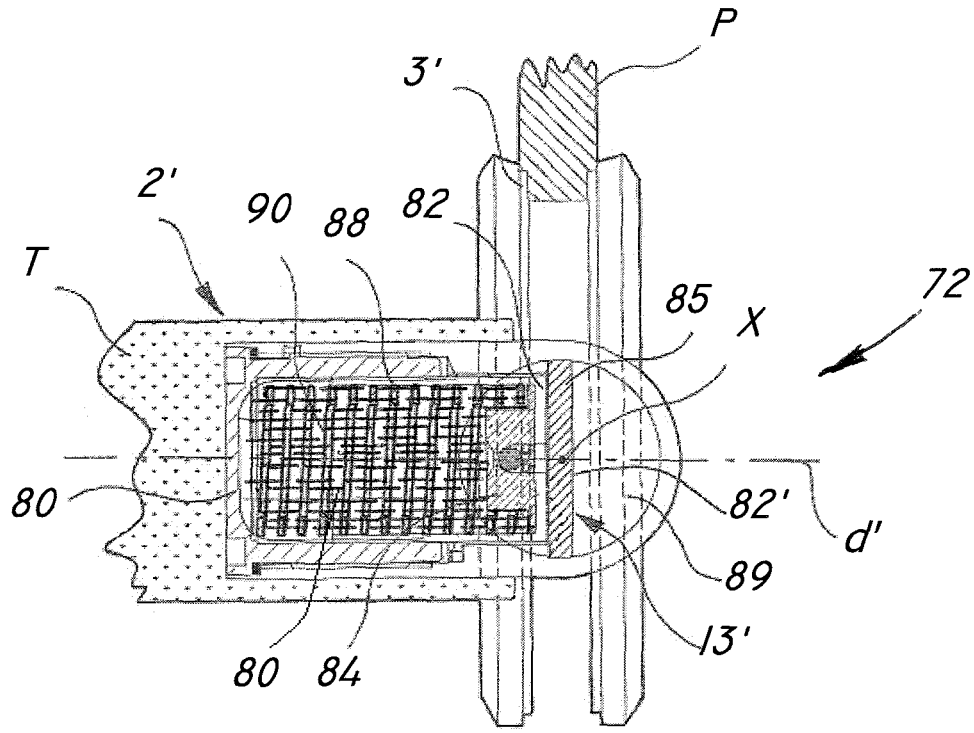
FIG. 31 is a view of the assembly of the invention in which the first and second hinge structures are cut away along respective planes L-L, L'-L', and in which they are in the open door position.
Figure 31:
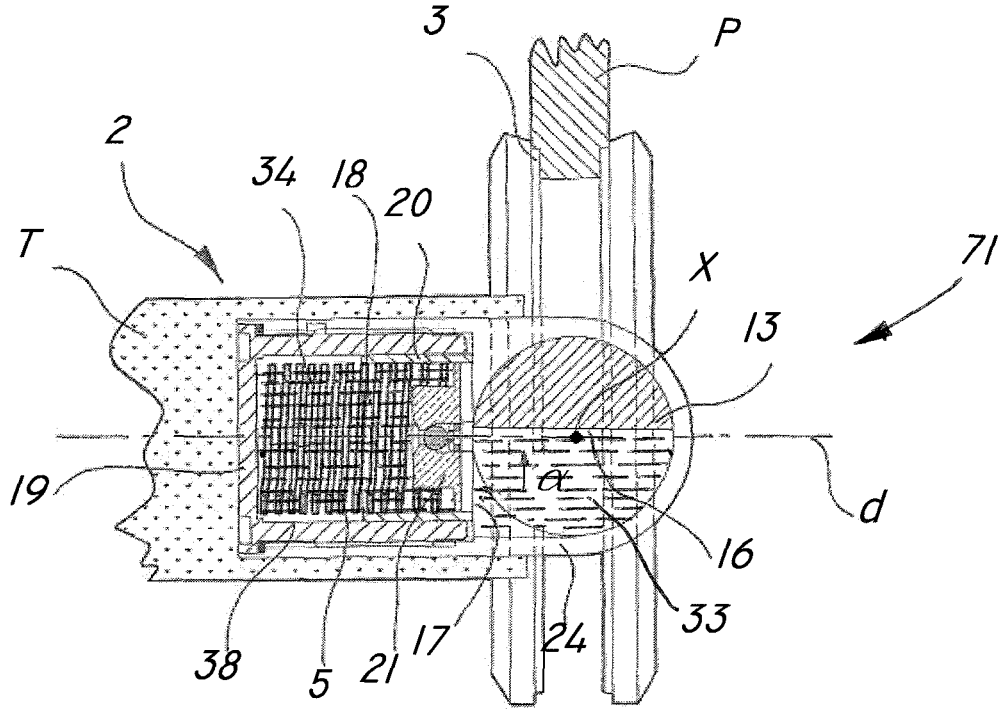

By this arrangement, an excellent control on the closing movement of the door is allowed. In fact, the offset of the contact surface 16 with respect to the longitudinal axis X allows the automatic closing of the door. This means that, when the door P is closed, starting from the fully open position, as shown in FIGS. 8*b*, 22 and 31, thanks to the distance g between the axis X and the surface 16, the front face 17 of the piston element 12 will promptly (after a few degrees of rotation) start to interact with the surface 16, thereby rotating the door P to the closed door position, as shown in FIGS. 7*a*, 20 and 29.

A first preferred, non exclusive embodiment of the invention is shown in FIGS. 2 to 8, in which there is only one operating chambers 6 containing the closing means 4 and the hydraulic damping means 5.

Figure 4A:
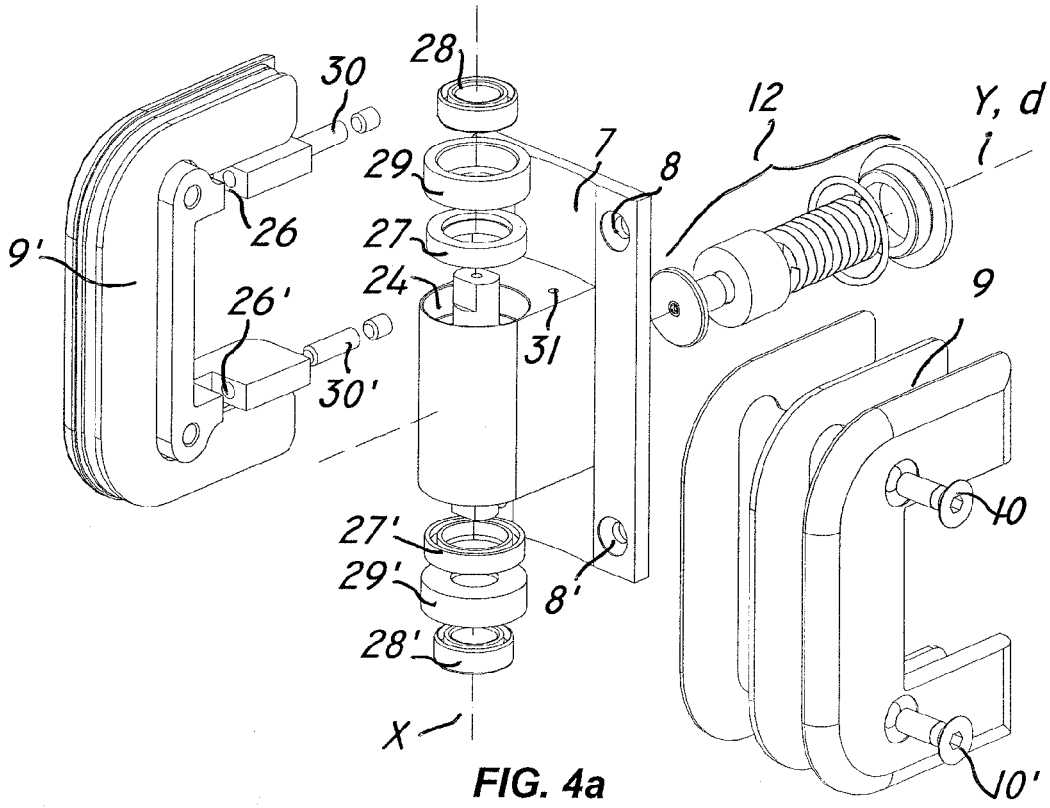
FIG. 4*a* is an exploded view of the hinge structure of FIG. 2, in a first preferred, non exclusive configuration.
Figure 4B:
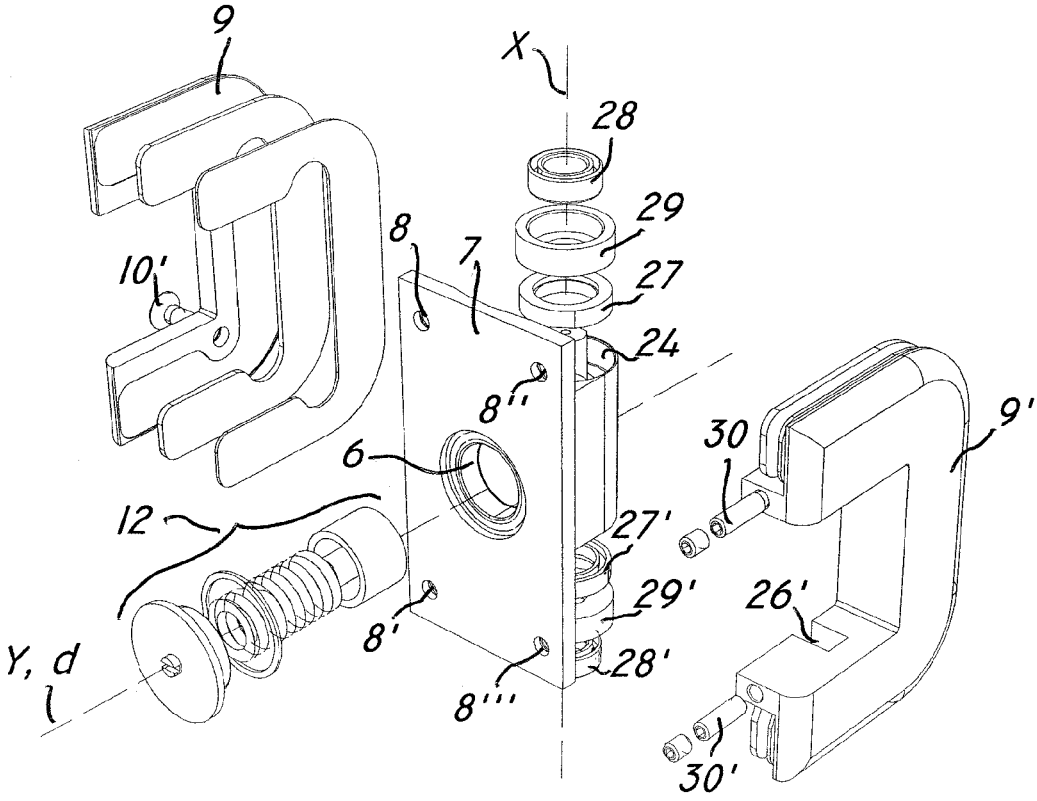
FIG. 4*b* is an exploded view of the hinge structure of FIG. 2, in a second preferred, non exclusive configuration.

In this embodiment, as shown in FIGS. 4*a* and 4*b*, the stationary element 2 may be defined by a base 7 to be fixed to the frame T by means of screws to be inserted in the holes 8, 8', 8'', 8''', whereas the movable element 3 may in turn comprise two half shells 9, 9' to be clamped together by screws 10, 10'.

Figure 5A:
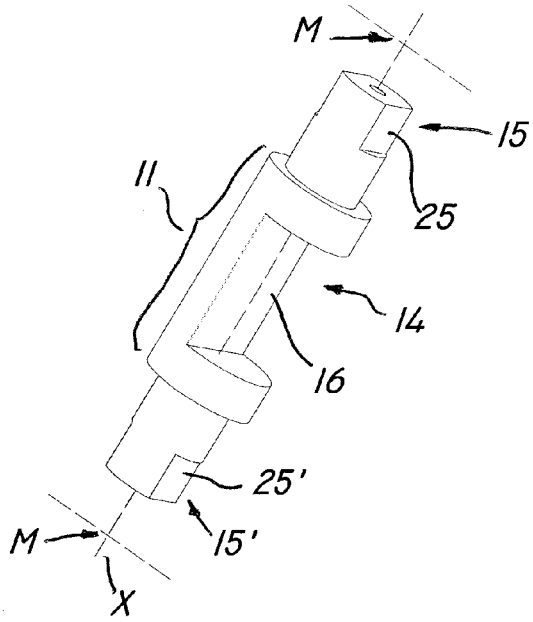
FIGS. 5*a* and 5*c* are axonometric views of the closing means 4 of the hinge structure of the invention.
Figure 5B:
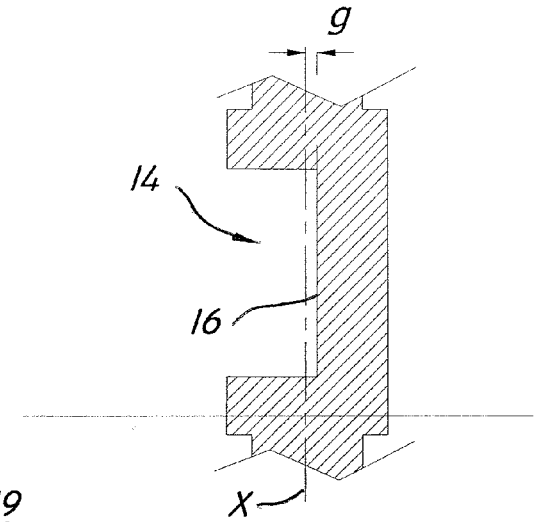
FIG. 5*b* is a sectional view of a few details of FIG. 5*a*, as taken along a plane M-M.
Figure 5C:
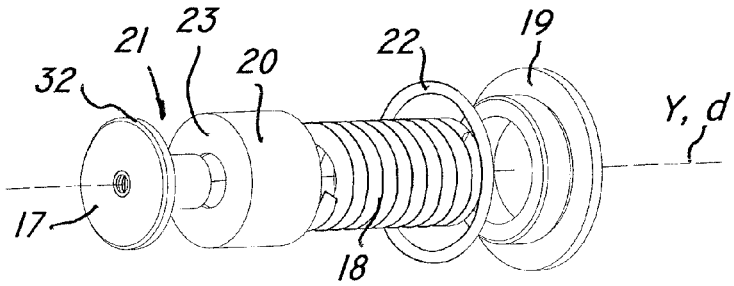
Figure 6:
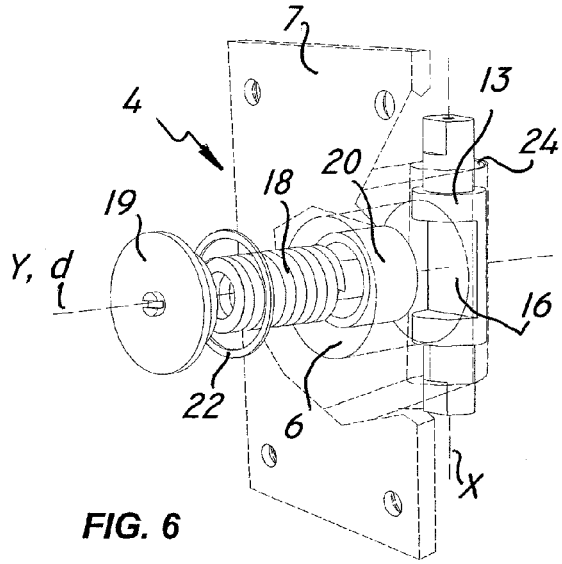
FIG. 6 is an enlarged view of certain details of the hinge structure of FIG. 5.

Advantageously, the closing means 4 may include a cam element 11, better shown in FIG. 5*a*, which is able to pivot about the axis X integrally with the movable element 3 and is susceptible of cooperating with a plunger element 12, better shown in FIG. 5*c*, which is longitudinally movable within the operating chamber 6.

The term "cam" as used herein is meant to indicate a mechanical member of any shape, which is adapted to turn a circular motion into a straight-line motion.

Conveniently, in this embodiment, the plunger element 12 operates along a line Y substantially orthogonal to the one defined by the longitudinal axis X, for minimized space requirement. As particularly shown in FIGS. 7 and 8, the line Y is defined by the axis of the cylindrical operating chamber 6.

A pin 13, particularly shown in FIG. 5*a*, which defines the axis X, is provided in the stationary element 2. The pin 13, which has to be mounted in a cylindrical receptacle 24 of the stationary element 2, has a suitably shaped central portion 14 which defines the cam element 11 and side portions 15, 15' to be connected to the movable element 3. By this arrangement, the cam 11 rotates integrally with the movable element 3.

The cam element 11, which is defined by the central portion 14 of the pin 13 comprises a substantially fiat surface 16, parallel to the axis X and abutting against the front face 17 of the plunger element 12. By rotating about the axis X, the surface 16 interacts with the front face 17 of the plunger element 12 to cause its straight-line motion along the line d. For this purpose, the operating chamber 6 and the cylindrical receptacle 24 are in mutual communication at the contact area between the surface 16 of the pin 13 and the front face 17 of the plunger element 12.

Advantageously, as particularly shown in FIG. 5*b*, the surface 16 has a distance g from the axis X of 1 to 6 mm, preferably of 1 mm to 3 mm and more preferably of about 2 mm. Thanks to such distance, the closing movement of the door will be completely automatic.

As shown in FIG. 5*c*, the plunger element 12 is composed a counter spring 18, a locking cap 19, a cover cylinder 20 and a check valve 21, which defines means for controlling the flow of oil 5 in the chamber 6, as better explained hereinbelow. The whole is "packed" and introduced, with the help of a gasket 22, in the operating chamber 6, with the locking cap 19 defining the bottom wall thereof.

It will be understood that the check valve 21 may be also mounted within the cover cylinder 20, as shown, for example in FIG. 4*b*. In this case, the front face 17 of the plunger element 12 is defined by the front face 23 of the cover cylinder 20.

As particularly shown in FIGS. 7*a*, 7*b*, 8*a* and 8*b*, the end wall 32 of the plunger element 12, which defines the front face 17 thereof, is susceptible of dividing the operating chamber 6 into a first and second variable volume compartments 33, 34, which are adjacent and in fluid communication with each other. The counter spring 18 is placed in the first compartment 33.

This embodiment of the hinge structure of the invention allows for very simple installation. The installation procedure is simply carried out by fitting the pin 13 in the cylindrical receptacle 24 of the stationary element 2, connecting the side portions 15, 15' thereof to the movable element 3 by introducing the surfaces 25, 25' of the pin 13 in the receptacles 26, 26' of the half shell 9', inserting the oil seals 27, 27', if any, thrust bearings 28, 28' and thrust bearing supports 29, 29' in the receptacle 24, securing the pin 23 to the shell 9' using the screws 30, 30' and clamping together the half shell 9 and the half shell 9' so installed by the screws 10, 10'. The plunger element 12, packed as described above, is introduced in its operating chamber 6, and the locking cap 19 is tightened.

Such assembly procedure is completed by introducing oil 5 in the operating chamber 6, for hydraulic damping of the closing movement produced by the closing means 4. For this purpose, a through hole 31 may be formed in the stationary element 2 to define an oil loading channel allowing communication between the operating chamber 6 and the external environment, as shown in FIG. 4*a*. It will be understood that the amount of oil to be loaded in the chamber 6, as well as the volume of the latter, is variable depending on the mass of the door P to be moved.

The operation of the hinge structure 1 is shown in FIGS. 7*a*, 7*b*, 8*a* and 8*b*.

In the closed door position, as shown in FIG. 7*a*, the flat surface 16 of the pin 13 and the front face 17 of the plunger element 12 are in contact with, substantially parallel to and abutting against each other. The counter spring 18 is precompressed between the cylinder 20 and the cap 19. In this position, substantially the whole amount of oil 5 is in the first variable volume compartment 33, which has the maximum volume. Also, the counter spring 18 is at its maximum elongation.

Figure 7B:
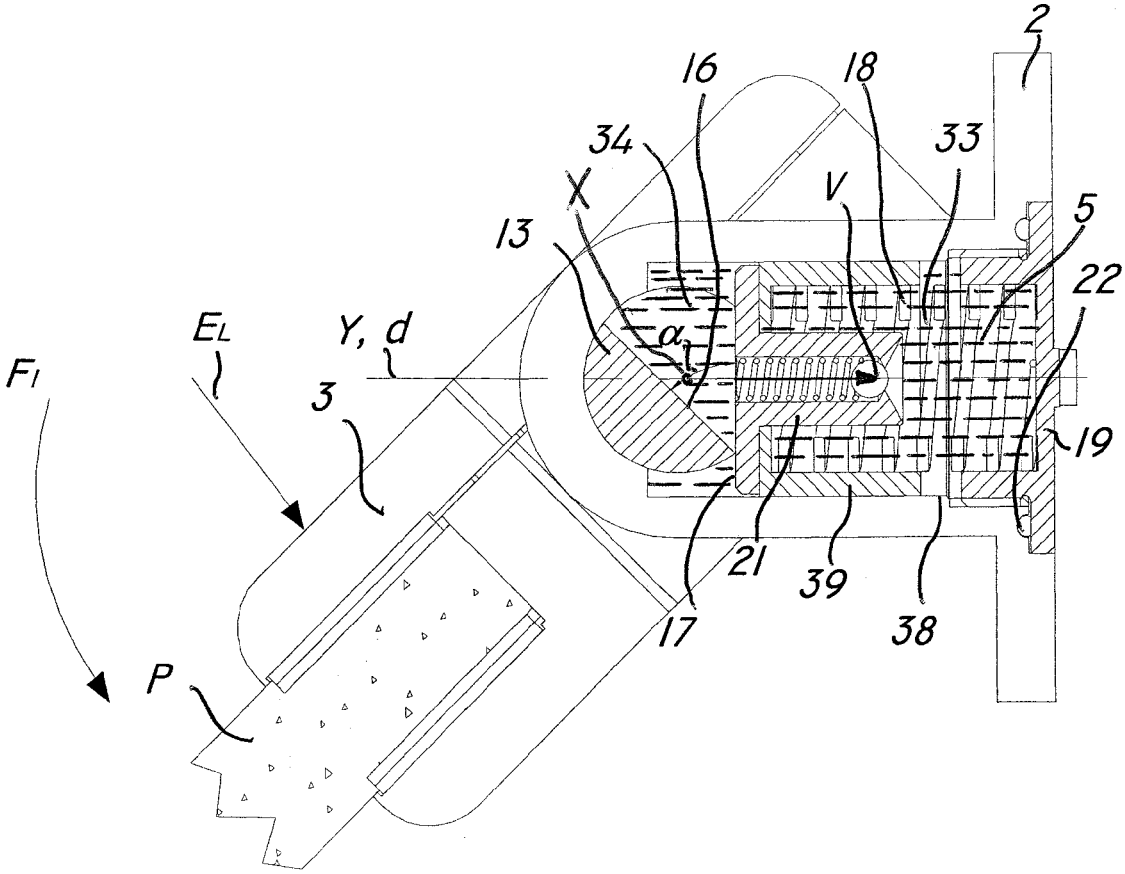
FIGS. 7*b* and 8*b* are sectional views of the hinge structure of FIG. 2 as taken along a plane B-B in partly open door conditions, during door opening and door closing respectively.

When a user opens the door P by applying an external load $E_L$ thereto, the door P moves in the direction of arrow $F_1$ from the closed door position to an open door position, as shown in FIG. 7*b*. This movement causes the flat surface 16 of the pin 13 to rotate about the axis X, and thence interact with the front face 17 of the plunger element 12 to compress the counter spring 18. The flat surface 16 of the pin 13 and the front face 17 of the plunger element 12 are angularly spaced apart by an angle $\alpha$ which increases as the door is being opened. The end wall 32 of the plunger element 12 is thus displaced along the line Y in the direction V. At the same time, due to the motion of the partition wall 32, the oil 5 is transferred from the first compartment 33, whose volume decreases, to the second compartment 34, whose volume accordingly increases, through the orifice 35 of the check valve 21.

In the embodiments illustrated herein, the check valve 21 is defined by an elongate extension 36 of the end wall 32 coaxial to the cylindrical operating chamber 6 and is of the normally open type, i.e. allowing the passage of oil 5 from the first compartment 33 to the second compartment 34 while the door is being opened and preventing it from flowing back as the door is being closed.

Figure 8A:
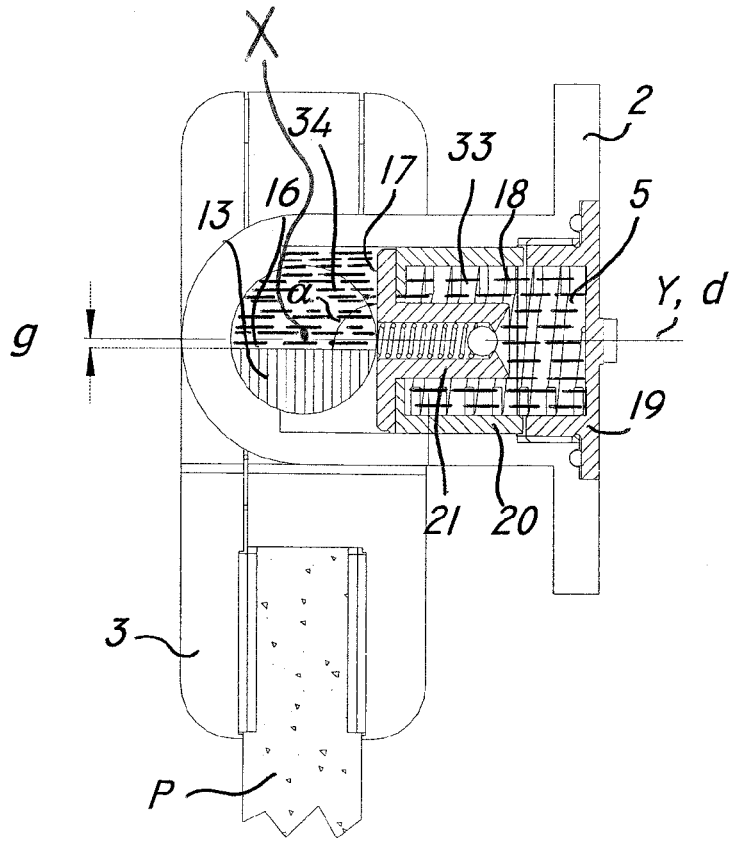
Figure 8B:
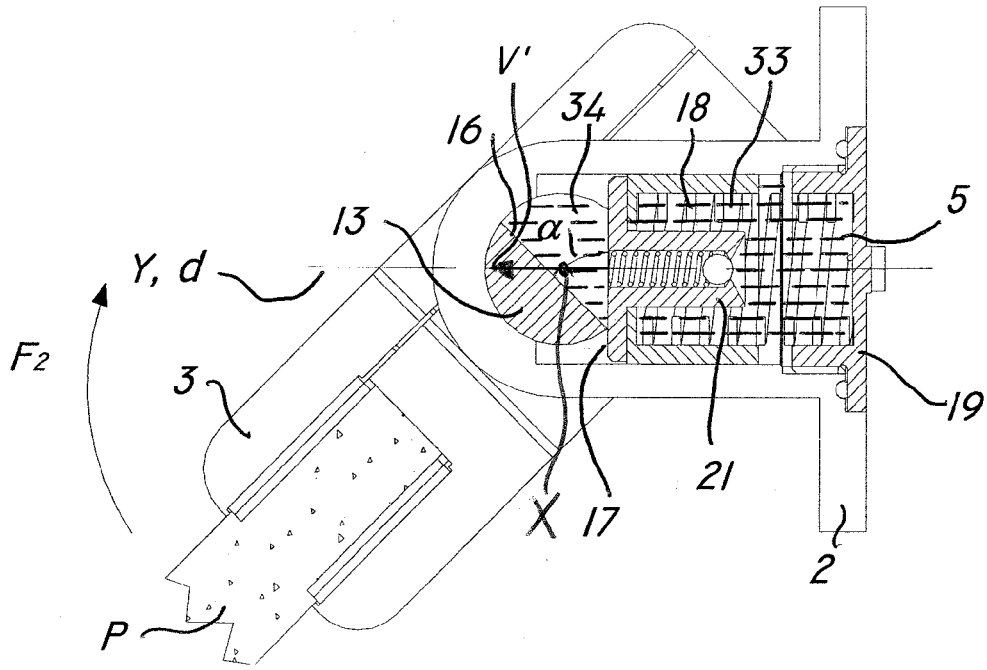
Figure 11:
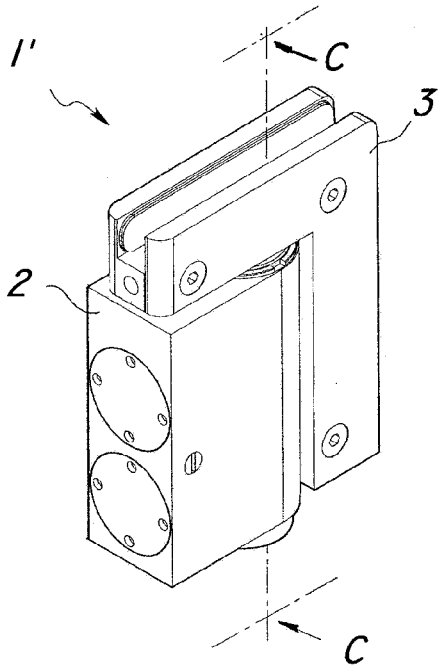
FIG. 11 is an axonometric view of a second embodiment of the hinge structure of the invention.
Figure 12:
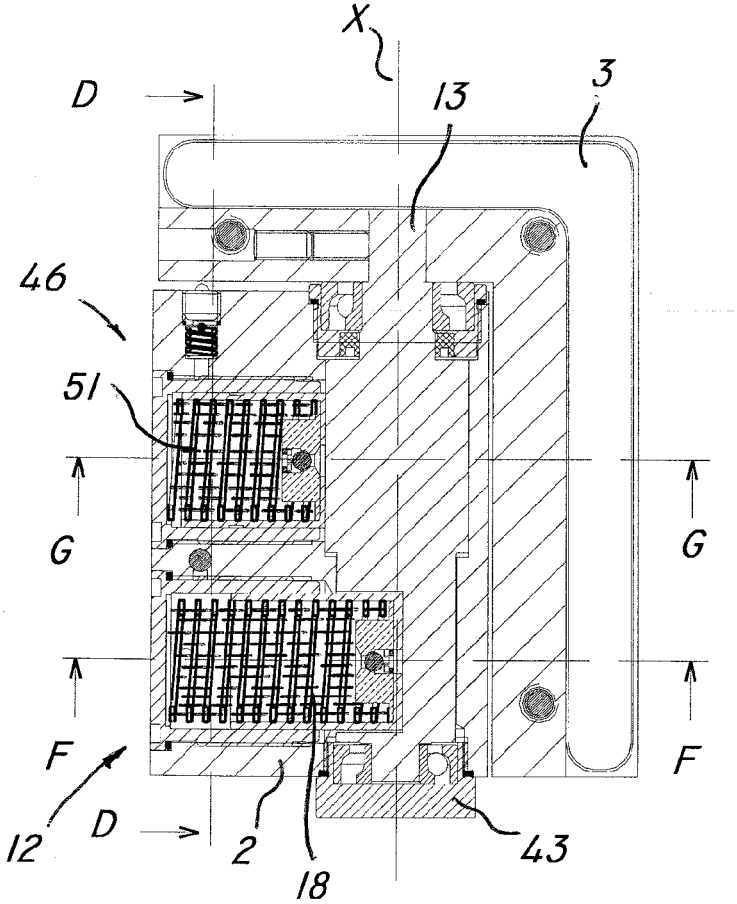
FIG. 12 is a sectional view of the structure of FIG. 11, as taken along a plane C-C.

FIG. 8*a* shows the fully open door position. In this position, the flat surface 16 of the pin 13 and the front face 17 of the plunger element 12 are perpendicular to each other. As shown in this figure, substantially the whole amount of oil 5 is in the second variable volume compartment 34, which has the maximum volume, while the first compartment 33 has the minimum volume. Also, the counter spring 18 is in its maximum compression position, which corresponds to its minimum elongation.

When a user rotates the door P from the fully open door position or, equivalently, when a user releases the door from a partly open door position (i.e. when the external load $E_L$ no longer acts thereon), the closing means 4 will start to operate on the movable element 3 to automatically return the door P to the closed position. At the same time, the hydraulic damping means 5 will start to operate on the movable element 3 to oppose and damp the closing movement produced by the closing means 4.

FIG. 8*b* shows the above condition, with the door P in a partly open door position during door closing, in the direction of arrow $F_2$. In this position, the flat surface 16 of the pin 13 and the front face 17 of the plunger element 12 are angularly spaced apart by an angle $\alpha$ which decreases as the door is being closed. The previously compressed spring 18 performs its opposing action by pushing the front face 17 of the plunger element 12 against the surface 16 of the pin 13, thereby causing the surfaces 16 and 17 to slide one against the other and the end wall 32 to move along the line Y in the direction V'. At the same time, due to the motion of the partition wall 32, the oil 5 is transferred from the second compartment 34, whose volume starts to decrease, to the first compartment 33, whose volume accordingly increases. However, the oil 5 will no longer flow through the orifice 35 of the check valve 21, which is closed, but will flow back into the first compartment 33 through a tubular space 37 between the side wall 38 of the operating chamber 6 and the side wall 39 of the cover cylinder 22 of the plunger element 12. Convenient adjustment of the size of the air space 37 may increase or decrease the damping effect provided by the oil 5, which makes the hinge structure of the invention exceptionally safe.

Figure 10:
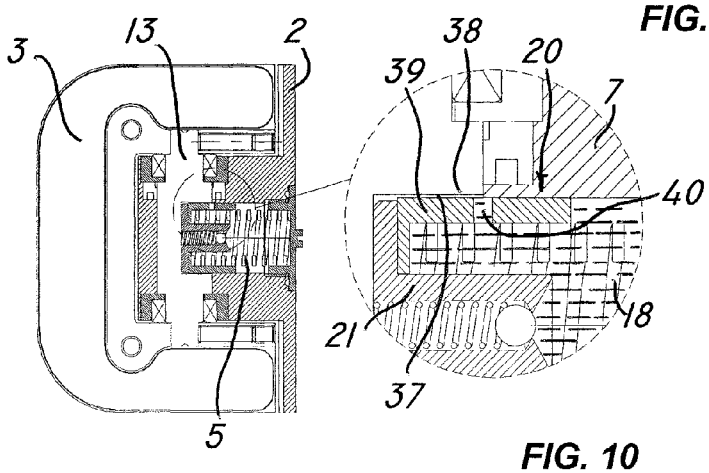

In an alternative configuration of the invention, as shown in FIG. 10, at least one hole 40 may be formed on the side wall 39 of the cover cylinder 20 of the plunger element 12, to facilitate and/or control the backflow of oil 5 into the first compartment 33. Suitable configuration of the sizes and/or number of holes 40, allows to control the return movement of the door P to the closed door position.

Figure 9:
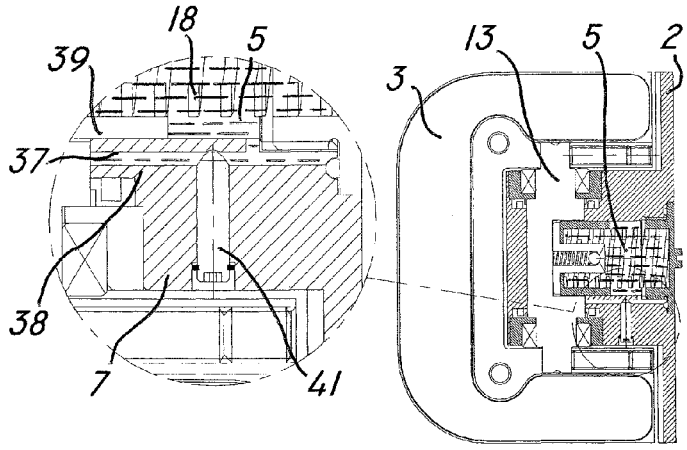
FIGS. 9 and 10 are sectional views of alternative embodiments of the hinge structure of FIG. 2 as taken along a plane A-A.

In a further alternative embodiment of the invention, as shown in FIG. 9, the structure 1 may comprise a screw 41 for throttling the air gap 37 and thereby adjusting its size as desired, to change the backflow velocity of the oil 5, and thus adjust the damping effect.

FIGS. 11 to 24 show without limitation a second embodiment of the hinge structure of the invention, generally designated by numeral 1'. The latter essentially comprises a stationary element 2 and a movable element 3 to be fixed to a door P by the two half shells 42, 42'. The stationary element 2 is designed to be fixed to a stationary support S, such as a wall or a floor, through the skirting 43, as shown in FIG. 24.

Figure 14:
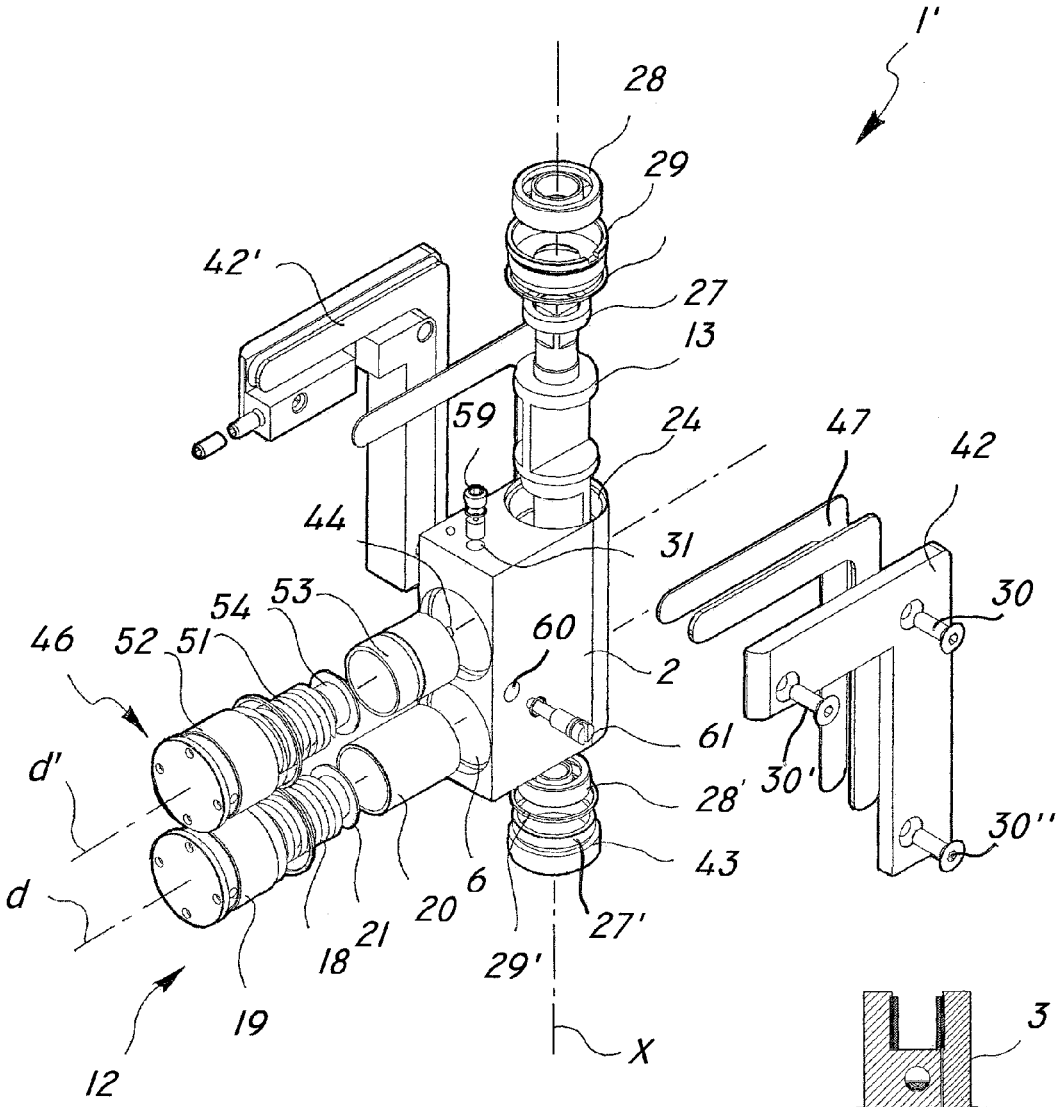
FIG. 14 is an exploded view of the structure of FIG. 11.

This second embodiment differs from the first embodiment in that, while the closing means 4 are held in a single first operating chamber 6, the hydraulic damping means 5 are held both in this first operating chamber 6 and in a second operating chamber 44, which is in fluid connection therewith. As shown in FIG. 14, both the first operating chamber 6 and the second operating chamber 44 are wholly contained in the box-like housing defined by the stationary element 2.

This configuration allows controlled movement of very heavy doors P and/or gates. This result is achieved thanks to the second operating chamber 44, which provides additional volume for the hydraulic damping means 5, whereby motion of objects of very large mass may be effectively controlled.

Figure 17:
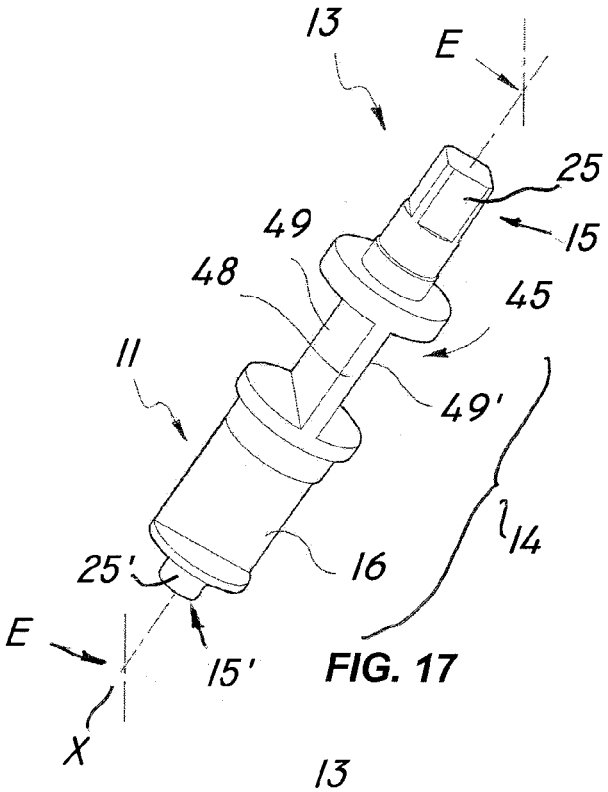
FIG. 17 is a sectional view of a first preferred non exclusive embodiment of the pin of the structure of FIG. 11.
Figure 18:
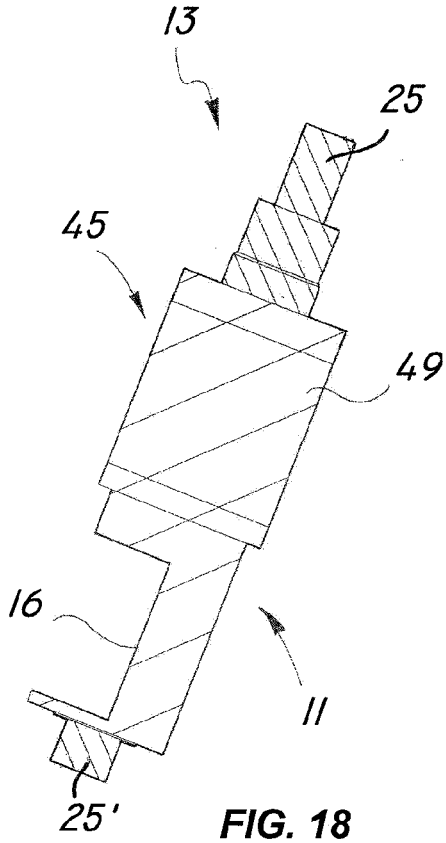
FIG. 18 is a sectional view of the pin of FIG. 17, as taken along a plane E-E.

In this second embodiment, the closing means comprise, in addition to the first cam element 11, a second cam element 45, which is able to pivot about the axis X integrally with the first cam element 11, as particularly shown in FIG. 17, Furthermore, the second cam element 45 cooperates with a second plunger element 46, which is longitudinally movable along the line Y" within the second operating chamber 44.

Advantageously, the line Y', which is defined by the axis of the second cylindrical operating chamber 44, is parallel to the line Y of motion of the first cam element 11, thereby minimizing space requirements.

In the second embodiment, the central portion 14 of the pin 13, which is always held within the stationary element 2 in a cylindrical receptacle 24, defines both the first cam element 11 and the second cam element 45.

The pin 13 is then designed to be fixed to the movable element 3 by means of the attachment surfaces 25, 25' of the end portions 15, 15'. Particularly, the top surface 25 is designed to be introduced in a groove 47 of the half shell 42 of the movable element 3, and the bottom surface 25' is introduced in the skirting 43 to be fixed to the floor S.

In this embodiment, both the first cam element 11 and the second cam element 45 are formed by specially shaping the central portion 14 of the pin 13. The first cam element 11, like in the first embodiment, comprises a first substantially flat surface 16, parallel to the axis X and abutting against the front face 17 of the first plunger element 12. The second cam element 45, placed above the first, is substantially defined by a wall 48 having a pair of second substantially flat surfaces 49, 49', parallel to the axis X and substantially perpendicular to the first surface 16.

The wall 48, with its surfaces 49, 49' abuts against the front face 50 of the second plunger element 46. For this purpose, as better shown in FIG. 16, the cylindrical receptacle 24 is designed to communicate both with the first operating chamber 6 and with the second 44, at the area of contact between the first cam element 11 and the first plunger element 12 and at the area of contact between the second cam element 45 and the second plunger element respectively.

The latter, like the first plunger element, is substantially composed of a second counter spring 51, a second locking cap 52, a second cover cylinder 53 and a second check valve 54, which defines means for controlling the flow of oil 5 in the second operating chamber 44, as explained above. The whole is "packed" and introduced, with the help of a second gasket 55, in the second operating chamber 44, with the locking cap 52 defining the bottom wall thereof.

As particularly shown in FIGS. 20 to 23, the end wall 50 of the second plunger element 46 is defined by a wall 56 which is susceptible of dividing the second operating chamber 44 into a third and fourth variable volume compartments 57, 58, which are adjacent and in fluid communication with each other. The counter spring 51 is placed in the fourth compartment 58.

Figure 13:
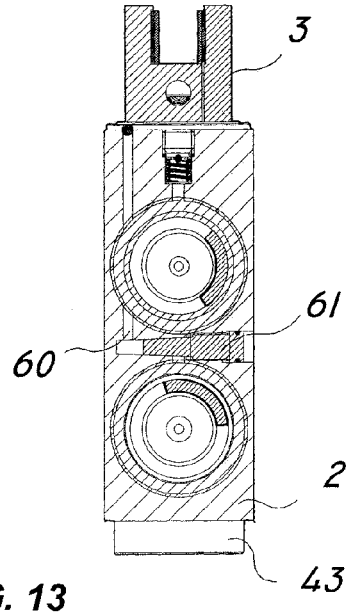
FIG. 13 is a sectional view of the structure of FIG. 11, as taken along a plane D-D.
Figure 15:
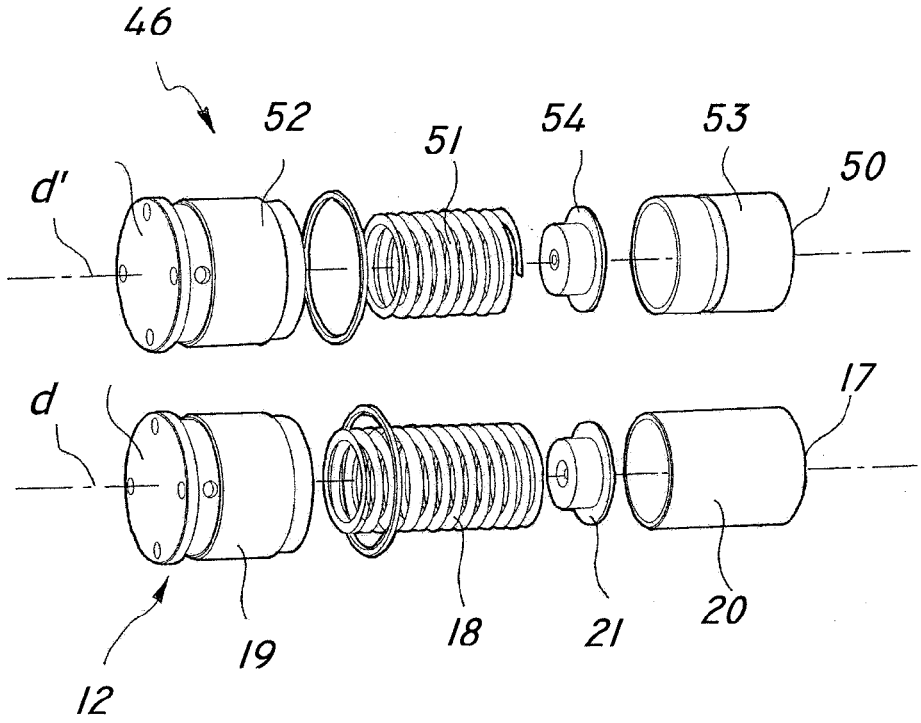
FIG. 15 is an exploded view of the first and second plunger elements of the structure of FIG. 11.
Figure 16:
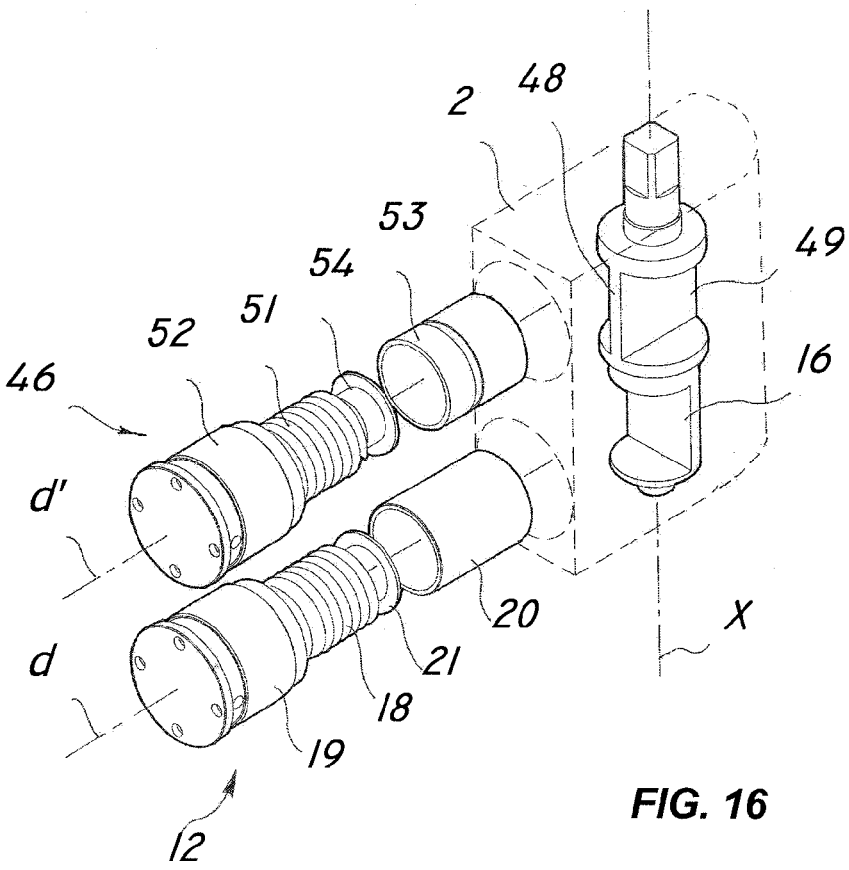
FIG. 16 is an exploded view of certain details of FIG. 11, in which the stationary element is indicated by dashed lines.

The stationary element 2 has a channel 60, clearly shown in FIG. 13, for putting the first and second operating chambers 6, 44 in fluid communication with each other. Furthermore, the channel 60 comprises a throttling screw 61, for adjusting the damping effect of the hydraulic means 5.

In the second embodiment described herein, the check valve 21 is of the normally open type, i.e. allowing the passage of oil 5 from the first compartment 33 to the second compartment 34 while the door is being opened and preventing it from flowing back as the door is being closed, whereas the check valve 54 is of the normally closed type, i.e. allowing the passage of oil 5 from the third compartment 57 to the fourth compartment 58 while the door is being opened and preventing it from flowing back as the door is being closed.

This embodiment of the hinge structure of the invention allows for very simple installation, like the first embodiment. The installation procedure is simply carried out by fitting the pin 13 in the cylindrical receptacle 24 of the stationary element 2, connecting the side portions 15, 15' thereof to the movable element 3, as described above, inserting the oil seals 27, 27', if any, thrust bearings 28, 28' and thrust bearing supports 29, 29' in the receptacle 24, and clamping together the half shell 42 and the half shell 42' so installed by the screws 10, 10', 10". The first plunger element 12, packed as described above, is introduced in its operating chamber 6, and the locking cap 19 is tightened, whereas the second plunger element is designed to be packed and introduced in the second operating chamber 44.

Such assembly procedure is completed by introducing oil 5 in the operating chambers 6 and 44, for hydraulic damping of the closing movement produced by the closing means 4. This may be accomplished using the loading channel 31 in the stationary element 2, which puts the external environment in communication with the second operating chamber 44, the latter being in turn in fluid communication with the first operating chamber 6. It will be understood that the predetermined amount of oil loaded through the channel 31 will be distributed among the first 33, the second 34, the third 57 and the fourth 58 variable volume compartments. The channel 31, which is particularly useful for adding oil 5 when needed, is closed by the cap 59.

The operation of the hinge structure 1 is better shown in FIGS. 20 to 23.

FIG. 20 shows the relative position of the closing means 4 and the hydraulic damping means 5 in the closed door position. In this position, the front face 17 of the first plunger element 12 abuts against and is parallel to the flat surface 16 of the first cam element 11 to keep the door closed, like in the first embodiment. The front face 50 of the second plunger element 46 abuts in turn against and is perpendicular to the wall 48 with its surfaces 49, 49'.

The first counter spring 18 is precompressed between the cylinder 20 and the cap 19, and the second counter spring 51 is compressed between the cap 52 and the cylinder 53. In this position, the first 33 and third 57 variable volume compartments have the maximum volume, and the second 34 and fourth 58 have the minimum volume. Also, the counter spring 18 is at its maximum elongation, and the second counter spring 51 has its minimum elongation (maximum compression position).

Figure 21:
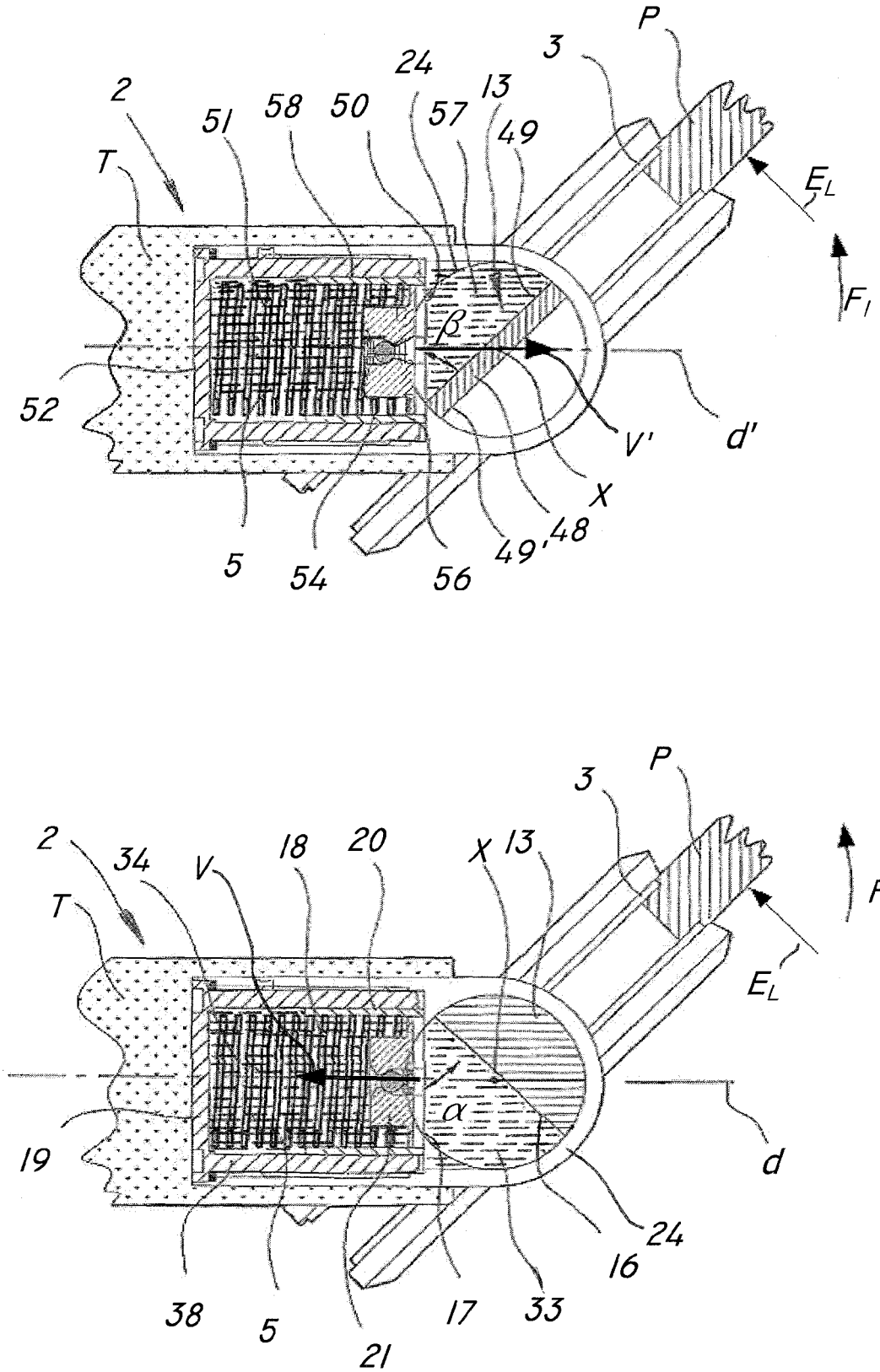

As the door P is opened, i.e. as an external load $E_L$ is applied thereon, the movable element 3 will start to pivot about the axis X relative to the stationary element 2, the pin 13 will move in the direction of arrow $F_1$, and the first surface 26 of the first cam element 11 and the second surfaces 49, 49' of the second cam element 45 will start to pivot integrally therewith. This partly open door position during door opening is shown in FIG. 21.

Due to the rotation of the pin 13, and the resulting thrust exerted by the surface 16 on the front face 17 of the first plunger element 12, the latter starts to move along the line Y in the direction V. At the same time, the second plunger element 48 starts to move along the line Y' in the direction V' opposite to the direction V. As the door is being opened, the angle α between the first flat surface 16 of the pin 13 and the front face 17 of the first plunger element 12 starts to increase, whereas the angle β between the flat surfaces 49, 49' of the second plunger element 46 starts to decrease.

Thus, the volume of the first compartment 33 starts to decrease, as loading of the first spring 18 occurs. Furthermore, as the volume of the first compartment 33 decreases, the oil 5 therein starts to flow out through the orifice 35 of the valve 21 into the second variable volume compartment 34, which starts to receive oil 5 and increases its volume.

At the same time, due to the rotation of the surfaces 49', 49 and the resulting thrust exerted by the front face 50 of the second plunger element 46 thereon, the volume of the fourth compartment 55 starts to increase, as release of the second spring 51 occurs. Also, the volume of the third compartment 57 starts to decrease, therefore the oil 5 therein starts to flow into the fourth compartment 58, whose volume accordingly increases.

FIG. 22 shows the fully open door position. It will be appreciated that the device of the invention allows 90° opening of the door also in the other direction. In this position, the fourth compartment 58 will have the maximum volume, whereas the second compartment 34 will have the minimum volume. The first spring 18 is in its maximum load condition (minimum elongation), and the second spring 51 is in its minimum load condition (maximum elongation).

As a user releases the door or moves it from the position of FIG. 22 to the closed position, the first spring 18 starts to be released, and the first plunger element 12 starts to push on the surface 16 of the pin 13 thereby rotating it in the direction of arrow $F_2$ back to the closed door position. At the same time, the surfaces 49, 49' compress the second spring 51, so that the volume of the fourth compartment 58 starts to decrease and oil flows out of it.

Figure 23:
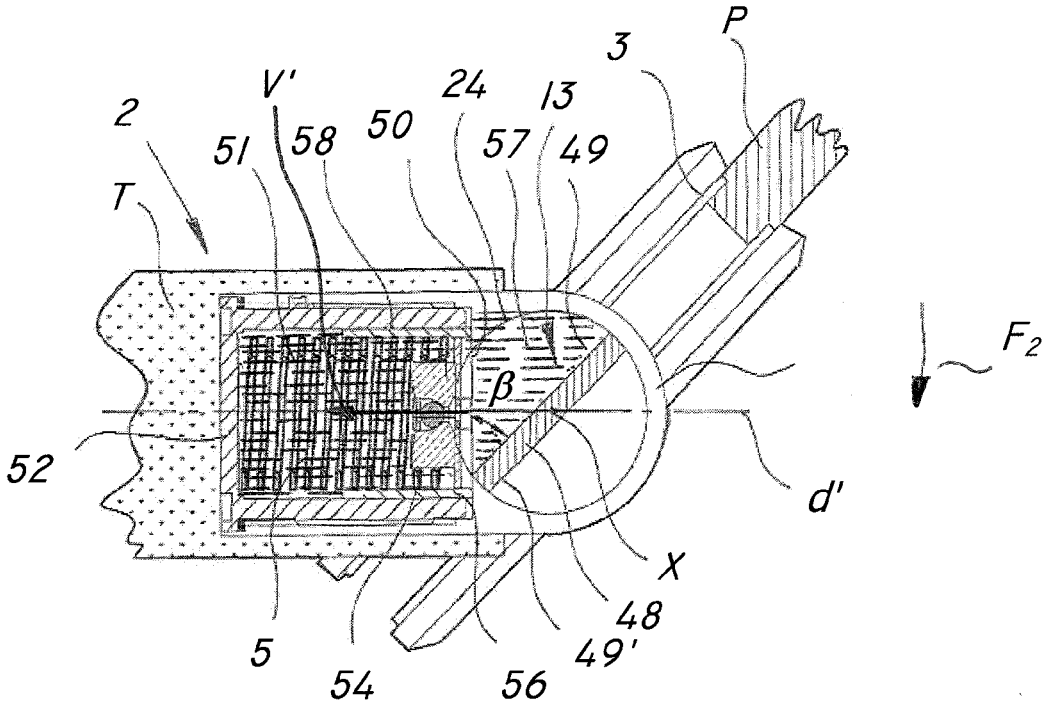
Figure 23:
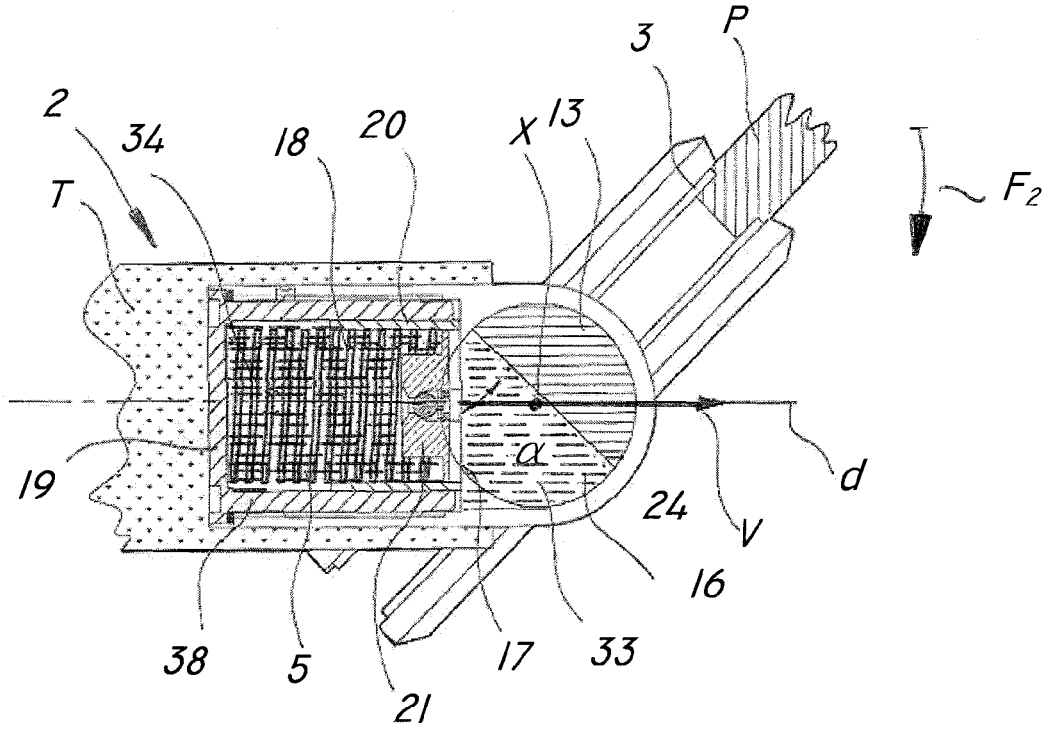
Figure 24:
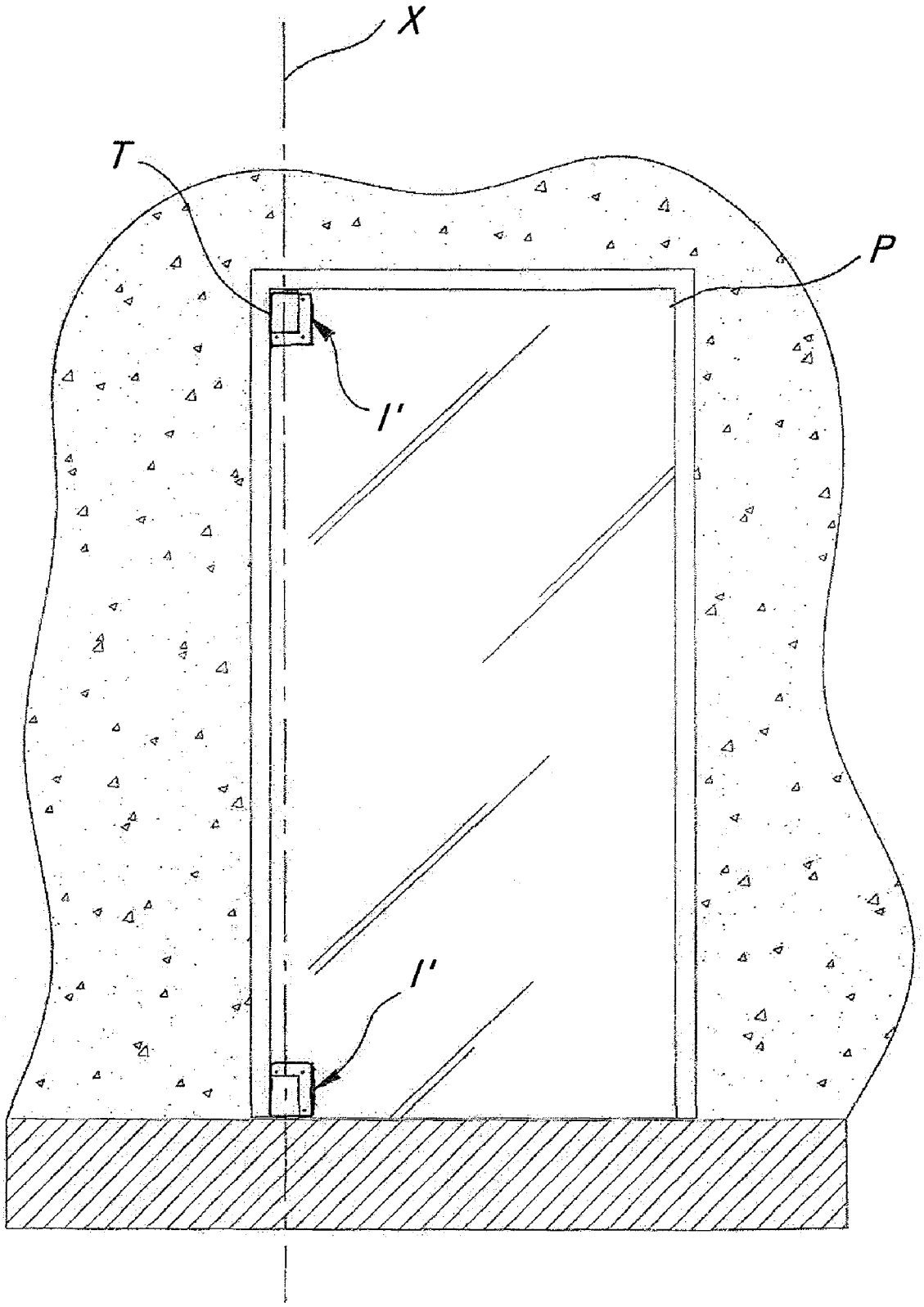
FIG. 24 is a view of a door with the second embodiment of the hinge structure of the invention mounted thereon.
Figure 25:
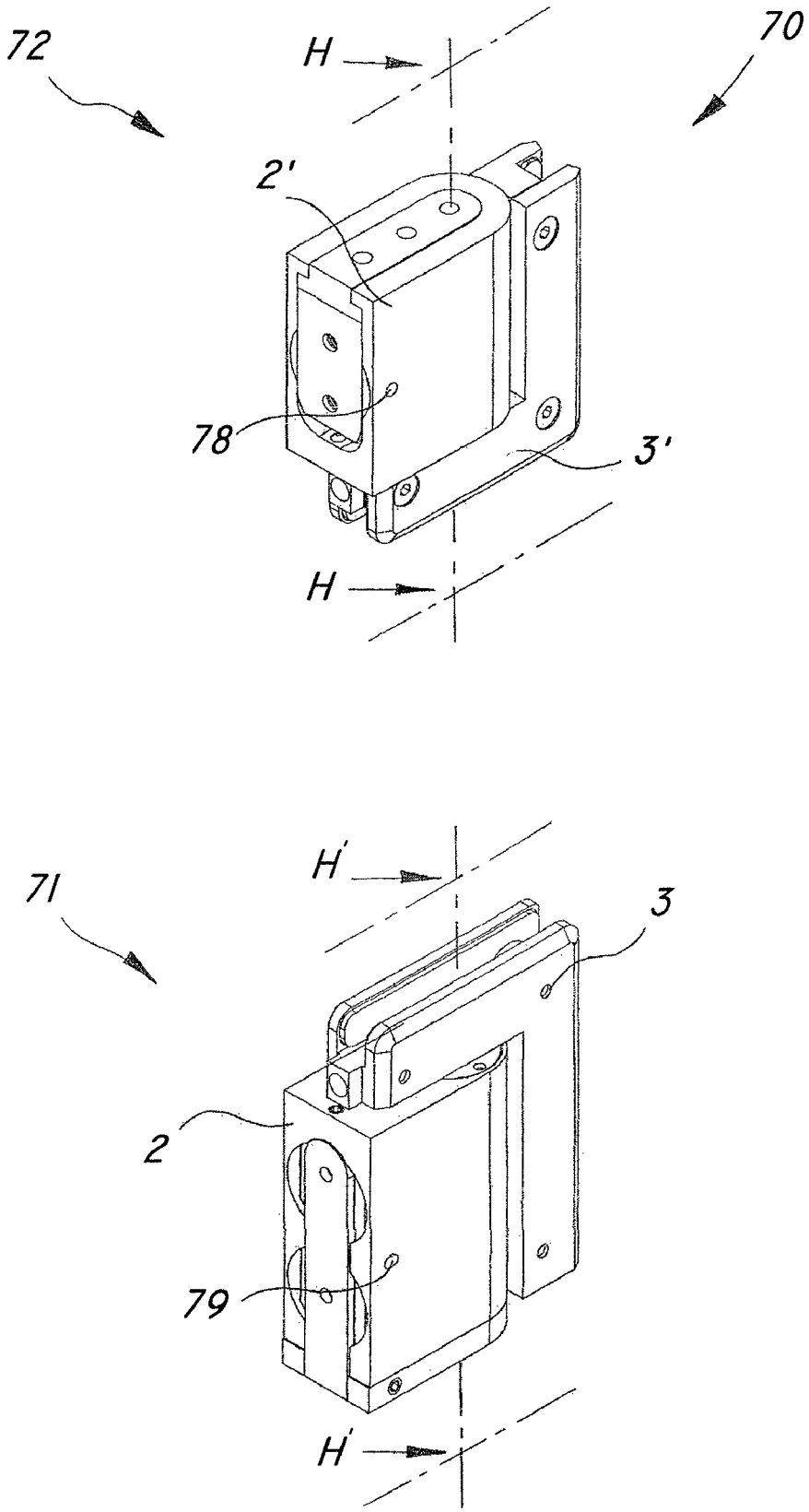
FIG. 25 is an axonometric view of the assembly of the invention.

FIG. 23 shows the above condition, with the door P in a partly open door position during door closing, in the direction of arrow $F_2$. In this position, the first flat surface 16 of the pin 13 and the front face 17 of the first plunger element 12 are angularly spaced apart by an angle α which decreases as the door is being closed, whereas the second flat surfaces 49, 49' of the pin 13 and the front face 50 of the second plunger element 46 are angularly spaced apart by an increasing angle β.

The previously compressed first spring 18 performs its opposing action by pushing the front face 17 of the first plunger element 12 against the first surface 16 of the pin 13, thereby causing the surfaces 16 and 17 to slide one against the other and the first end wall 32 to move along the line Y in the direction V. Now, the second spring 51 is also compressed due to the pressure of the second wall 48 of the second cam element 45 against the second plunger element 46, which moves along the line Y' in the direction V', opposite to the direction V.

The second valve 54 is of the normally closed type and does not allow the passage of the working fluid through its orifice 62, whereby oil 5 is forced to flow out at the hole 63 into the air gap 63 defined by the side walls 65, 66 of the second operating chamber 44 and the second cover cylinder 53 respectively. The outflowing oil 5 flows through the channel 60 into the first compartment 33 whose volume progressively increases.

The first valve 21, which is of the normally open type, does not allow the passage of oil 5 through its orifice 35, wherefore oil will flow from the second compartment 34 to the third compartment 57, which are in fluid communication with each other.

In fact, in the second embodiment as shown in the figures, the working fluid follows a counter-clockwise path within the box-like housing defined by the stationary element 2, to hydraulically delay the rotary motion of the movable element 3 with respect to the return movement thereof to the closed door position. Likewise, the working fluid is also delayed during door opening, so that the hinge structure of the invention is highly safe even for outdoor installations, In which wind or a careless user might exert an excessive load on the door.

Figure 19:
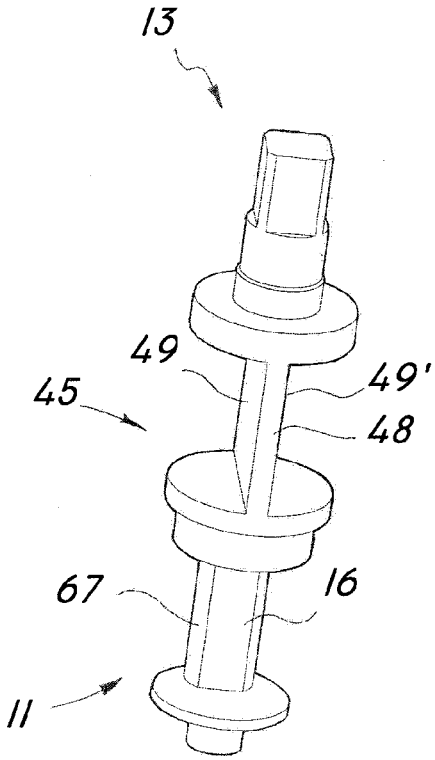
FIG. 19 is a sectional view of a second preferred non exclusive embodiment of the pin of the structure of FIG. 11.

In an alternative embodiment of the invention, as shown in FIG. 19, the first cam element 11 of the pin 13 may have a rounded peripheral surface, e.g. formed by turning, to allow the door P to be moved back to the closed door position from any open door position. This embodiment is particularly advantageous for fire doors.

FIGS. 25 to 32 show a preferred, non exclusive embodiment of a hinge assembly, generally designated by numeral 70, to be mounted on self-closing doors P or the like. The assembly 70 comprises a first and a second hinge structures 71 and 72, each comprising a stationary element 2, 2' to be fixed to the frame T of the door P and a movable element 3, 3' to be fixed to the door P. The movable elements 3, 3' are pivotally mounted to their respective stationary elements 2, 2' for rotating about the axis X. In this embodiment, the door P acts as a "drive shaft" between the two hinge structures 71, 72.

Figure 28:
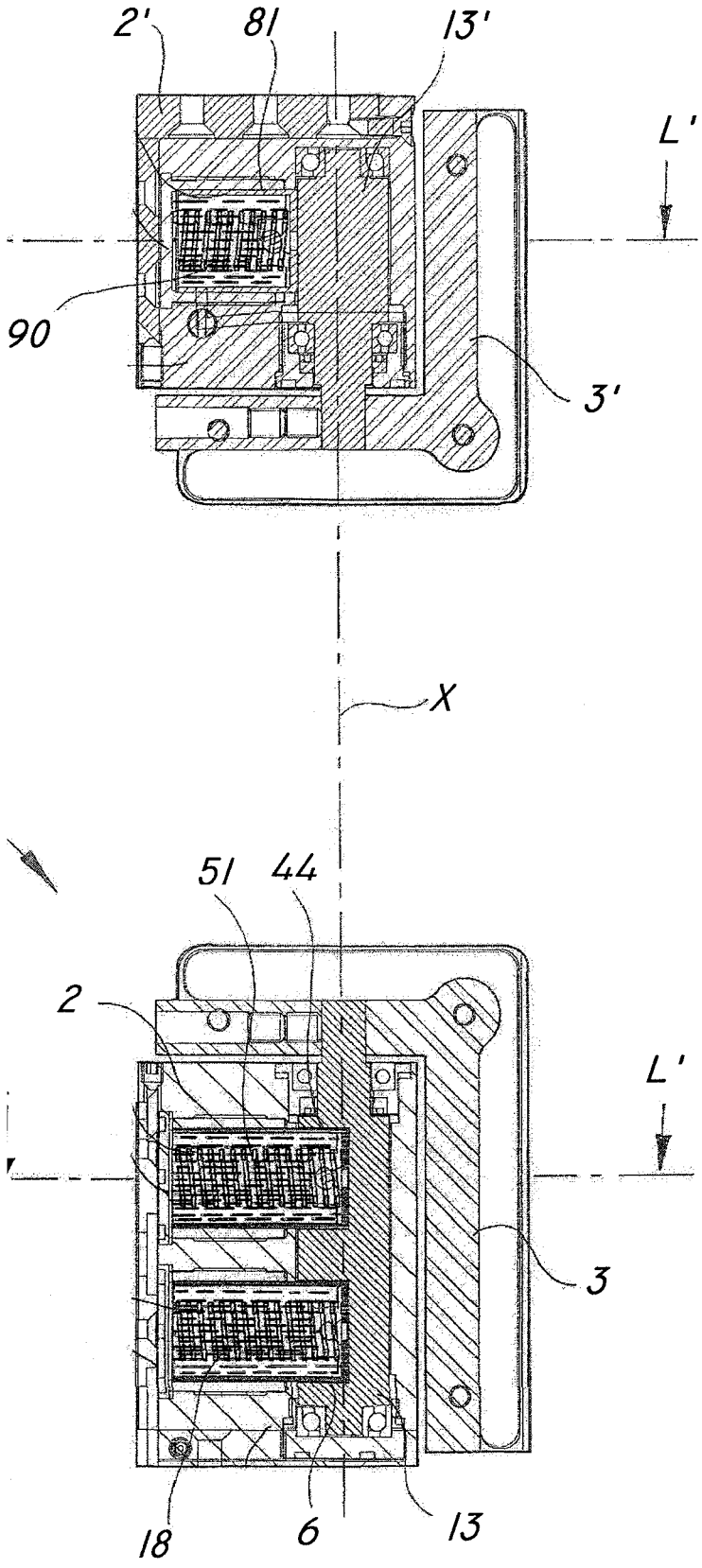
FIG. 28 is a view of the assembly of the invention in which the first and second hinge structures are cut away along respective planes H-H, H'-H'.

As particularly shown in FIG. 28, the closing means 4 and the hydraulic damping means 5 are held in two operating chambers 6, 44 within the box-like housing defined by the first stationary element 2 of the first hinge structure 71, whereas the second hinge structure 72 comprises second damping means 80, which may also consist of a predetermined amount of the same oil as used in the first hinge structure 71, contained in another operating chamber 81 within the box-like housing defined by the second stationary element 2'.

In other words, the first hinge structure 71 operates on the movable element 3 (and thence on the movable element 3') to generate the torque C required to cause the door P to pivot to its closed position about the axis X, whereas the second hinge structure 72 operates on its movable element 3' (and thence on the movable element 3) to hydraulically damp the movement produced by the hinge structure 71, thereby generating a resistant torque C' opposite the torque C.

This configuration allows for optimized motion control of very heavy doors and gates, during both the opening and closing movements.

Concerning both construction and operation, the first hinge structure 71 is very similar to the first embodiment as shown herein in FIGS. 1 to 10, or to the lower half of the second embodiment as shown herein in FIGS. 11 to 24. However, the second hinge structure 72 is very similar, still in terms of construction and operation, to the upper half of the second embodiment as shown herein in FIGS. 11 to 24. The only functional and structural difference between the latter and the hinge assembly 70 is that the operating chambers 6, 44 and the operating chamber 81 are not in fluid communication with each other, although their operation is identical. In an alternative embodiment, the assembly 70 of the invention may be formed of the first embodiment of the hinge structure, as shown in FIGS. 1 to 10 (with the closing means held in a single operating chamber 6) and the hinge structure 72.

The second hinge structure 72 comprises a second pin 13' having a corresponding contact surface 82 which is designed to interact with another plunger element 83 associated to the second damping means 80.

The contact surface 82 of the second pin 13' is substantially perpendicular to the surfaces 16 and 49 of the first pin 13 of the first hinge structure 71.

Furthermore, the second pin 13' has a central portion 14' that defines a corresponding cam element 86, as well as side portions 87, 87' that are appropriately shaped for connection with the second movable element 3'.

The cam element 86 interacts with the corresponding plunger element 83 as described above.

The second hinge structure 72 further comprises a corresponding check valve 84 located at an end wall 85 of the plunger element 83 to allow the passage of oil 80 during door closing and prevent backflow thereof during door opening. The wall 85 divides the operating chamber 81 into respective variable volume compartments 88 and 89, a counter spring 90 being located in the compartment designated by numeral 88.

As particularly shown in FIGS. 29 to 32, the check valves 21, 54 and 84 associated to their respective plunger elements 12, 46 and 83 are of the normally open type.

A further difference between the second hinge structure 72 and the upper half of the second embodiment as shown in FIGS. 11 to 24 is that the second check valve 84 is of the normally open type (like the first valves 21, 54), i.e. allows the passage of oil 5 from the fourth compartment 58 to the third compartment 57 during door opening and prevents backflow thereof during door closing.

Thus, unlike the second embodiment as shown in FIGS. 11 to 24, the first valves 21, 54 and the second check valve 84 operate in the same directions, i.e. open during door opening and close during door closing.

The first and second hinge structures 71 and 72 are assembled in the same manner as those described above. Two channels 78, 79 are provided for filling oil 5 once the assembly has been completed.

Figure 26:
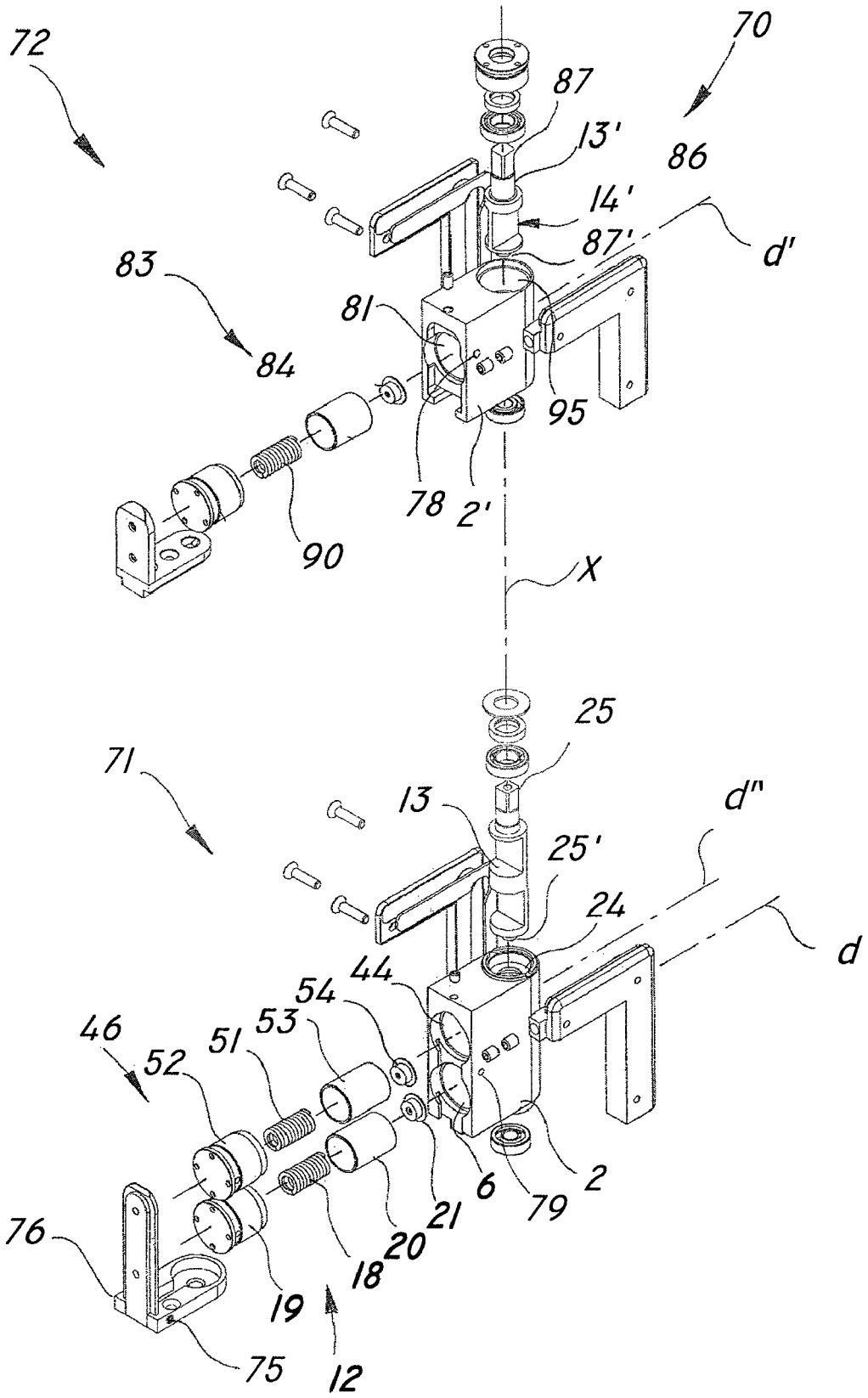
FIG. 26 is an axonometric view of the assembly of the invention in which the first and second hinge structures are shown in exploded configuration.
Figure 27:
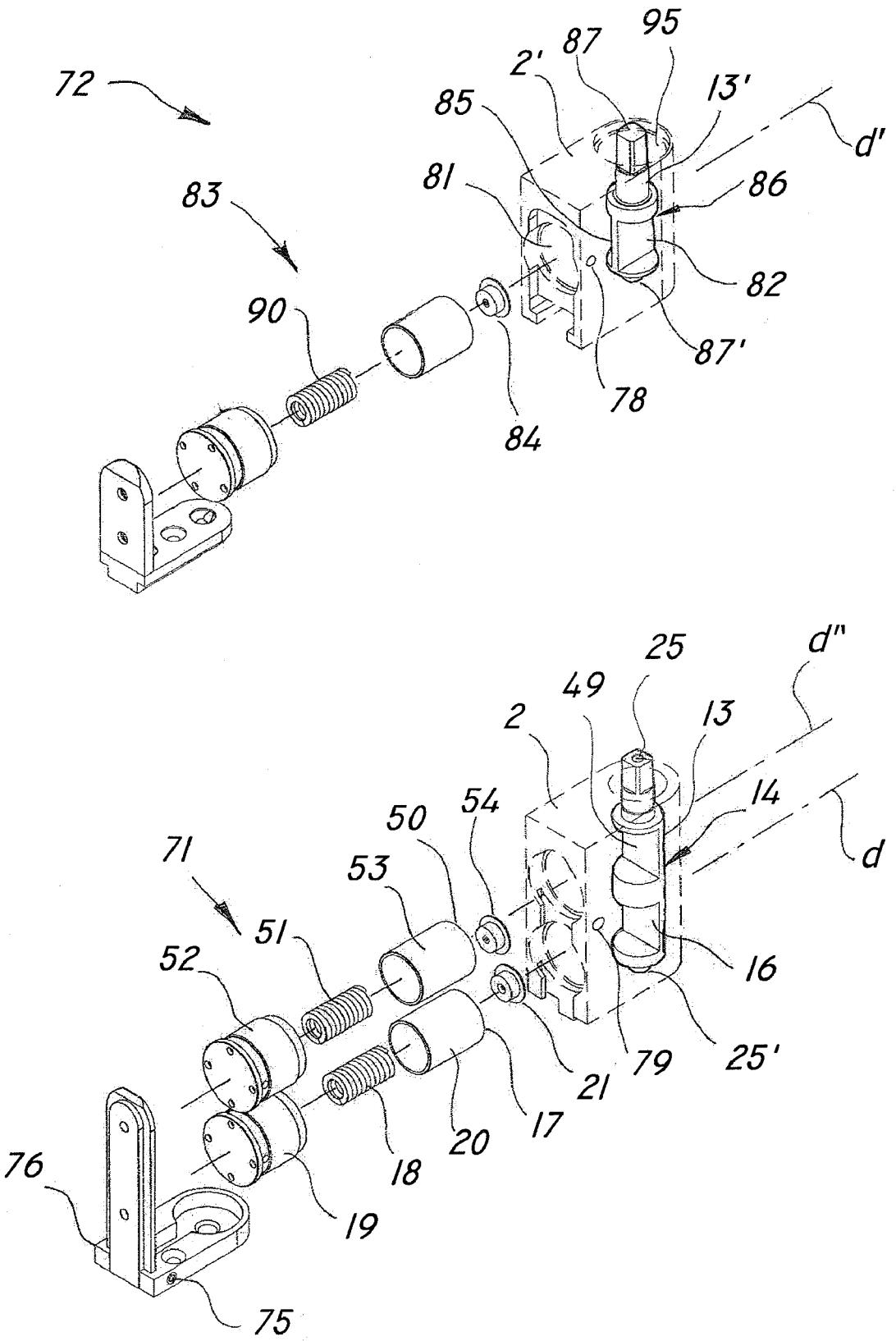
FIG. 27 is an axonometric view of the assembly of the invention in which the first and second stationary elements are shown by dashed lines.

In operation, the first and second hinge structures 71, 72 are mounted to the door P and cooperate to control its pivotal movement about the axis X. As shown in FIG. 26, their pins 13 and 13' are configured in such a manner that the overlapping flat surfaces of the former and the opposite flat surfaces 82, 82' of the latter are perpendicular to each other.

To adjust the alignment of the door P, the first hinge structure 71 may have suitable adjustment dowels 75, 76.

The operation of the assembly 70 is identical to that of the second embodiment of the hinge structure as shown in FIGS. 11 to 24, except that the flow of oil 5 is controlled by normally open check valves 21, 54, whereas the oil 80 is controlled by the valve 84, which is of the same type.

FIG. 29 shows the first and second hinge structures 71, 72 in the closed door P position, and FIG. 31 shows the first and second hinge structures 71, 72 in the fully open door P position. It will be understood that, while FIGS. 29 to 32 only show the upper portion of the hinge structure 71, the parts of the lower portion, not shown, operate exactly like those of the upper portion.

Figure 30:
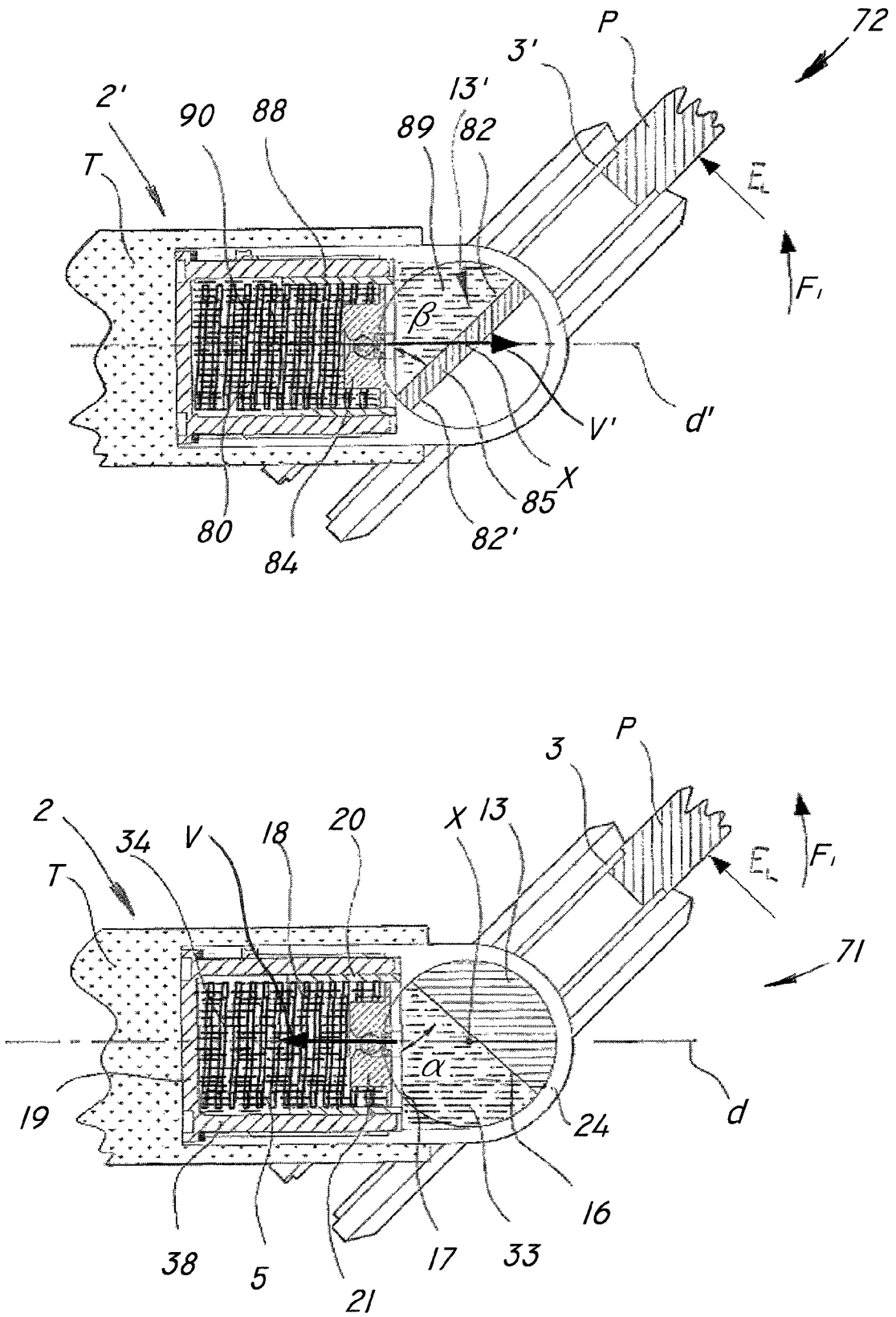
FIG. 30 is a view of the assembly of the invention in which the first and second hinge structures are cut away along respective planes L-L, L'-L', and in which they are in an intermediate opening position.

As the door P is opened by a user, i.e. as an external load $E_L$, is applied thereon, e.g. in the direction of arrow $F_1$ as shown in FIG. 30, the first pin 12 and the second pin 13' pivot about the axis X and cause the overlying surface 16 and the opposite flat surfaces 82, 82' respectively to rotate about the same axis X. The spring 18 of the first plunger element 12 starts to be compressed, whereas the spring 90 starts to be released.

Thus, the volume of the first compartment 33 starts to decrease, as loading of the first spring 18 occurs. Furthermore, as the volume of the first compartment 33 decreases, the oil 5 therein starts to flow out through the orifice 35 of the valve 21 into the second variable volume compartment 34, which starts to receive oil 5 and increases its volume.

At the same time, due to the rotation of the surfaces 82', 82, the volume of the compartment 89 starts to increase, as the spring 90 starts to be released. Also, the volume of the compartment 88 starts to decrease, therefore the oil 80 therein starts to flow into the adjacent compartment 89, whose volume accordingly increases. However, since the valve 84 is of the normally open type, the oil 80 cannot pass through the orifice of the valve, and will flow into the compartment 89 through an air gap 91 between the side wall 92 of the operating chamber 81 and the side wall 93 of the plunger element 83.

As a user releases the door or moves it from the position of FIG. 31 to the closed position, the first spring 18 starts to be released, and the first plunger element 12 starts to push on the surface 16 of the pin 13 thereby rotating it in the direction of arrow $F_2$ back to the closed door position. At the same time, the surface 82 (or 82', depending on the door opening direction) compresses the spring 90, so that the volume of the compartment 89 starts to decrease and oil 80 flows out of it.

Figure 32:
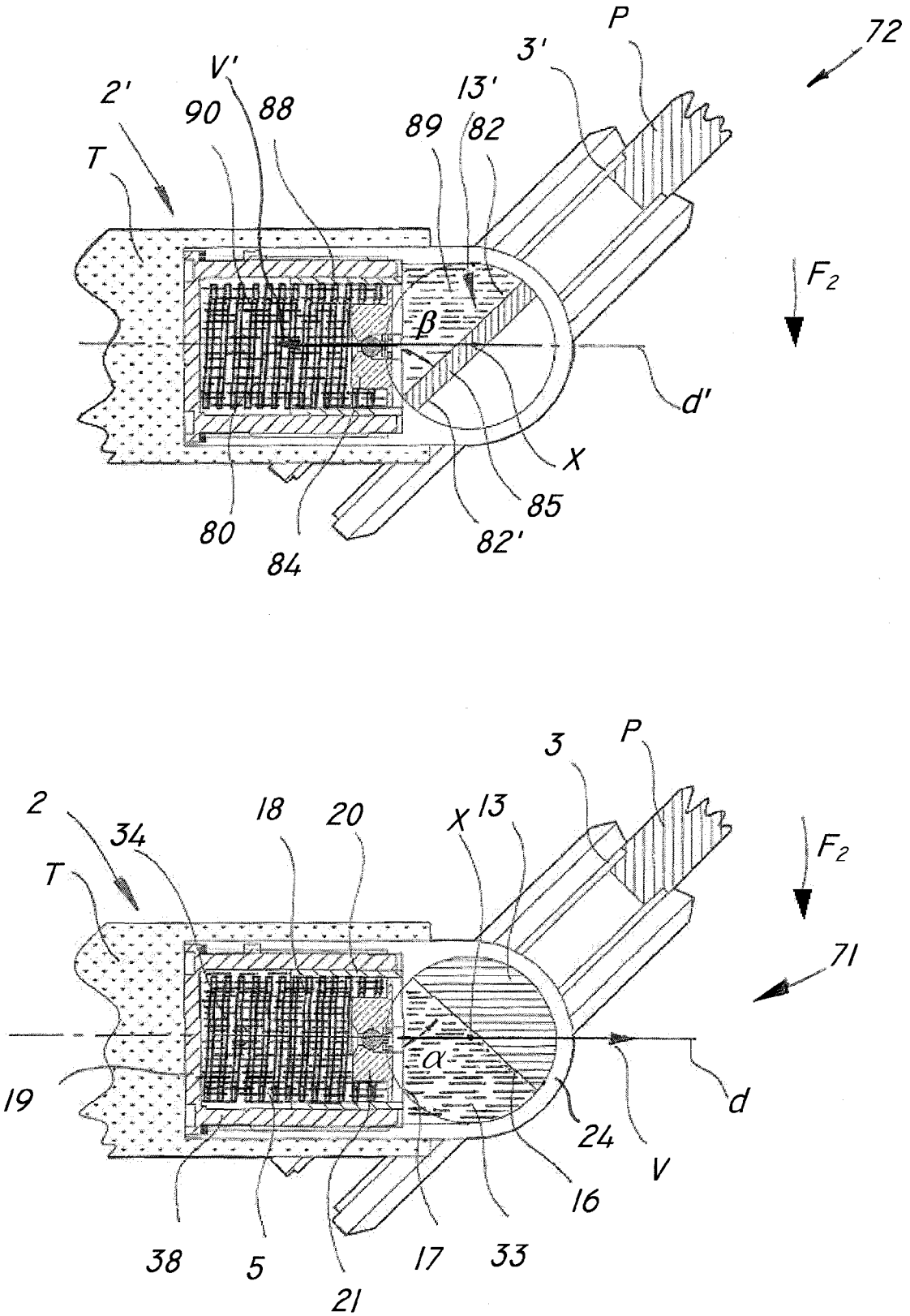
FIG. 32 is a view of the assembly of the invention in which the first and second hinge structures are cut away along respective planes L-L, L'-L', and in which they are in an intermediate closing position.

FIG. 32 shows the above condition, with the door P in a partly open door position during door closing, in the direction of arrow $F_2$. The previously compressed first spring 18 performs its opposing action by pushing the front face 17 of the first plunger element 12 against the first surface 16 of the pin 13, thereby causing the surfaces 16 and 17 to slide one against the other and the first end wall 32 to move along the line Y in the direction V. Now, the second spring 90 is also compressed due to the pressure of the cam element 86 against the plunger element 83, which moves along the line Y' in the direction V', opposite to the direction V.

The first valve 21, which is of the normally open type, does not allow the passage of oil 5 through its orifice 35, wherefore oil will flow from the second compartment 34 to the first compartment 33 through the air gap 37 between the side wall 38 of the operating chamber 6 and the side wall 39 of the cylinder 20. The valve 84, whish is also of the normally open type, allows the passage of oil 80 through its orifice, to cause it to flow from the variable volume compartment 89 to the compartment 88.

It will be understood that both the first 71 and the second 72 hinge structures may include fluid flow control means, like in the first and second embodiments described hereinbefore. This will afford control during both opening and closing of the door P. Thus, the door may be designed to oppose no (or very low) resistance at low closing speeds, and to increase its resistance as the door P closing speed increases.

Thanks to this arrangement, if the door is mounted outdoors, it can be designed to be easily opened by users, while not being slammed because of external agents, such as wind or the like.

The above disclosure clearly shows that the hinge structure and assembly of the invention fulfill the intended objects and particularly meet the requirement of assuring controlled movement of the door both during opening and closing thereof.

During door closing, such controlled movement prevents the door from banging against its frame, thereby ensuring integrity and long life thereof.

On the other hand, during opening, such controlled movement will prevent any abrupt opening of the door P due to gusts of wind, to protect both the door and any user within its operating range.

The hinge structure and assembly of the invention are susceptible of a number of changes and variants, within the inventive concept disclosed in the appended claims, All the details thereof may be replaced by other technically equivalent parts, and the materials may vary depending on different needs, without departure from the scope of the invention.

While the hinge structure and assembly have been described with particular reference to the accompanying figures, the numerals referred to in the disclosure and claims are only used for the sake of a better intelligibility of the invention and shall not be intended to limit the claimed scope in any manner.

The invention claimed is:

1. A hinge structure coupling a door to a frame and comprising:

a first stationary element;

a first movable element configured to cause a door to rotate about a longitudinal axis between an open door position and a closed door position, the first movable element being pivotally mounted onto the first stationary element;

closing means acting on the first movable element to automatically return the door to the closed position upon opening thereof; and hydraulic damping means acting on the first movable element to oppose and damp a closing movement of the closing means;

a first operating chamber housing the closing means and the hydraulic damping means, wherein the closing means comprise a first cam element having a first contact surface, and a first plunger element movable within the first operating chamber along a transverse axis between a compressed end position, corresponding to the open door position, and an extended end position, corresponding to the closed door position, the plunger element having a front face which is adapted to engage the first contact surface of the cam element, wherein the closing means comprise first counteracting elastic means operating on the first plunger element and urging the front face against the first contact surface of the first cam element, and wherein the first plunger element has a side wall and an end wall defining the front face, the end wall being designed to separate the first operating chamber into a first variable volume compartment and a second variable volume compartment which are in fluid communication with each other, the first counteracting elastic means being located in the first compartment.

2. The hinge structure of claim 1, wherein the first variable volume compartment is configured to have a maximum volume and the second variable volume compartment configured to have a minimum volume when the door is in the closed position.

3. The hinge structure of claim 2, further comprising a first check valve at the end wall of the first plunger element, the first check valve being designed to allow a flow of a working fluid from the first compartment into the second compartment upon opening of the door and to prevent backflow thereof during closing of the door.

4. The hinge structure of claim 3, wherein the side wall of the first plunger element defines an air gap within a side wall of the first operating chamber an air gap such to control backflow of the working fluid from the second to the first variable volume compartments upon closing of the door.

5. The hinge structure of claim 1, wherein the first contact surface of the first cam element is offset with respect to the longitudinal axis by a predetermined distance such that the front face of the plunger element in the extended end position is positioned beyond the longitudinal axis, allowing the automatic returning of the door to the closed position.

6. The hinge structure of claim 5, wherein the predetermined distance is between 1 mm and 5 mm.

7. The hinge structure of claim 1, further comprising a pin having an axis coincident with the longitudinal axis, the pin having a central portion including the first contact surface.

8. The hinge structure of claim 7, wherein the first operating chamber is located internally of the first stationary element, the pin being located internally of the first stationary element, the first cam element being unitary with the pin.

9. The hinge structure of claim 1, wherein the first contact surface is substantially parallel to the longitudinal axis.

10. The hinge structure of claim 1, wherein the counteracting first elastic means act along a transverse direction that is substantially parallel to the transverse axis and substantially orthogonal to the longitudinal axis.

11. The hinge structure of claim 1, wherein the stationary element comprises a multi-sided body configured to house the closing means and the hydraulic damping means.

12. The hinge structure of claim 1, wherein the first variable volume compartment and the second variable volume compartment are adjacent.

13. The hinge structure of claim 1, wherein the first contact surface is substantially flat.

14. A hinge structure coupling a door to a frame and comprising:

a first stationary element;

a first movable element configured to cause a door to rotate about a longitudinal axis between an open door position and a closed door position, the first movable element being pivotally mounted onto the first stationary element;

closing means acting on the first movable element to automatically return the door to the closed position upon opening thereof;

hydraulic damping means acting on the first movable element to oppose and damp the closing movement of the closing means; and a first operating chamber housing the closing means and the hydraulic damping means, wherein the closing means comprise a first cam element having a first contact surface, and a first plunger element movable within the first operating chamber along a transverse axis between a compressed end position, corresponding to the open door position, and an extended end position, corresponding to the closed door position, the plunger element having a front face which is adapted to contact engage the surface of the cam element, wherein the closing means comprise first counteracting elastic means operating on the first plunger element for urging the front face against the first contact surface of the first cam element, wherein the first plunger element has a side wall and an end wall defining the front face, the end wall being designed to separate the at least one first operating chamber into a first variable volume compartment and a second variable volume compartment which are in fluid communication with each other, the first counteracting elastic means being located in the first compartment, and wherein the hinge structure comprises a second operating chamber, the closing means being housed in the first operating chamber, the hydraulic damping means being housed both in the first operating chamber and in the second operating chamber.

15. The hinge structure of claim 14, wherein the closing means include a second cam element and a second plunger element, which is longitudinally movable within the second operating chamber and is susceptible of cooperating with the second cam element.

16. The hinge structure of claim 15, further comprising a pin having an axis coincident with the longitudinal axis, the pin having a first central portion having the first contact surface, wherein the first contact surface is substantially flat, the central portion of the pin having a second contact surface overlying the first contact surface, the second contact surface being substantially flat and defining the second cam element.

17. The hinge structure of claim 16, wherein the second plunger element has a second end wall for dividing the second operating chamber into a third and a fourth adjacent variable volume compartments which are in mutual fluid communication, second elastic means for urging the second plunger element against the second cam element being located in the fourth compartment.

18. The hinge structure of claim 17, wherein the first and the second elastic means have operating directions substantially orthogonal to the longitudinal axis and in opposite senses.

19. The hinge structure of claim 17, wherein one or more of the closing means or the hydraulic damping means are designed to cause the third variable volume compartment to have a minimum volume and the fourth variable volume compartment to have a maximum volume with the door in the closed position.

20. The hinge structure of claim 19, further comprising a second check valve at the second end wall of the second plunger element, for allowing a flow of a working fluid from the third variable volume compartment into the fourth variable volume compartment during opening of the door and to prevent backflow thereof during closing of the door.

21. The hinge structure of claim 16, wherein the second contact surface of the second cam element is substantially parallel to the longitudinal axis and substantially perpendicular to the first contact surface of the first cam element.

22. The hinge structure of claim 16, wherein the first operating chamber is located internally of the first stationary element, the pin being located internally of the first stationary element, the first cam element being unitary with the pin.

23. The hinge structure of claim 14, wherein the first variable volume compartment and the second variable volume compartment are adjacent.

24. A door hinge assembly coupling a door to a frame and comprising:

a first hinge structure comprising, a first stationary element;

a first movable element configured to cause a door to rotate about a longitudinal axis between an open door position and a closed door position, the first movable element being pivotally mounted onto the first stationary element;

closing means acting on the first movable element to automatically return the door to the closed position upon opening thereof, hydraulic damping means acting on the first movable element to oppose and damp the closing movement of the closing means, and a first operating chamber housing the closing means and the hydraulic damping means, wherein the closing means comprise a first cam element having a first contact surface, and a first plunger element movable within the first operating chamber along a transverse axis between a compressed end position, corresponding to the open door position, and an extended end position, corresponding to the closed door position, the plunger element having a front face which is adapted to contact engage the surface of the cam element, wherein the closing means comprise first counteracting elastic means operating on the first plunger element for urging the front face against the first contact surface of the first cam element, and wherein the first plunger element has a side wall and an end wall defining the front face, the end wall being designed to separate the at least one first operating chamber into a first variable volume compartment and a second variable volume compartment which are in fluid communication with each other, the first counteracting elastic means being located in the first compartment, and a second hinge structure operatively coupled to the door in a longitudinally staggered position with respect to the first hinge structure, wherein the second hinge structure differs from the first hinge structure by having no closing means and by comprising second damping means braking and damping the closing movement produced by the closing means of the first hinge structure.

25. The hinge assembly of claim 24, wherein the first hinge structure comprises a first pin having an axis coincident with the longitudinal axis, the first pin having a central portion including the first contact surface, the second hinge structure comprising a second pin having a corresponding second contact surface which is designed to interact with corresponding second plunger means associated to the second damping means.

26. The hinge assembly of claim 25, wherein the first and second contact surfaces are substantially flat, the second contact surface of the second pin being substantially perpendicular to the first contact surface of the first pin associated to the first hinge structure.

27. The hinge assembly of claim 26, wherein the first hinge structure comprises a first check valve at the end wall of the first plunger element, the first check valve being designed to allow a flow of a working fluid from the first compartment into the second compartment upon opening of the door and to prevent backflow thereof during closing of the door, the second hinge structure comprises a corresponding second check valve located at an end wall of its plunger element to allow passage of the working fluid during closing of the door and prevent backflow thereof during opening of the door.

28. The hinge assembly of claim 27, wherein the first and second check valves associated to corresponding plunger elements of the first and second hinge structures are of a normally open type.

29. The hinge structure of claim 25, wherein the first operating chamber is located internally of the first stationary element, the first pin being located internally of the first stationary element, the first cam element being unitary with the pin.

30. The hinge structure of claim 24, wherein the first variable volume compartment and the second variable volume compartment are adjacent.

* * * * *